US009708145B2

(12) United States Patent
Uchino et al.

(10) Patent No.: US 9,708,145 B2
(45) Date of Patent: Jul. 18, 2017

(54) IMAGE RECORDING APPARATUS

(71) Applicant: Brother Kogyo Kabushiki Kaisha, Nagoya-shi, Aichi-ken (JP)

(72) Inventors: Yuta Uchino, Nagoya (JP); Kenji Samoto, Nagoya (JP); Wataru Sugiyama, Nishio (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/055,703

(22) Filed: Feb. 29, 2016

(65) Prior Publication Data

US 2016/0289025 A1 Oct. 6, 2016

(30) Foreign Application Priority Data

Mar. 31, 2015 (JP) ..... 2015-071354

(51) Int. Cl.
*B65H 5/00* (2006.01)
*B65H 5/06* (2006.01)
(Continued)

(52) U.S. Cl.
CPC ..... *B65H 5/068* (2013.01); *B65H 5/062* (2013.01); *B65H 9/006* (2013.01); *B65H 85/00* (2013.01);
(Continued)

(58) Field of Classification Search
CPC ..... B65H 2403/731; B65H 2403/722; B65H 2403/61; B65H 2403/5333;
(Continued)

(56) References Cited

U.S. PATENT DOCUMENTS 8,915,494 B2 12/2014 Samoto et al.
2011/0222947 A1* 9/2011 Iijima ..... B65H 5/062 400/578
(Continued)

FOREIGN PATENT DOCUMENTS

JP 56-10472 * 2/1981
JP 56-49290 * 5/1981
(Continued)

OTHER PUBLICATIONS

Machine translation of JP 56-49290.*

*Primary Examiner* — Thomas Morrison
(74) *Attorney, Agent, or Firm* — Banner & Witcoff, Ltd.

(57) ABSTRACT

A first roller is driven, by a conveying motor rotating in a normal direction and in a reverse direction, to rotate in a forward direction and in a backward direction, respectively. The first roller and a second roller convey a sheet in a conveying direction by rotating in the forward direction. The transmission unit transmits a driving force of the conveying motor to the second roller and includes a first rotary member. The transmission unit has such play that when the conveying motor is switched from rotation in a normal direction to rotation in a reverse direction, rotation of the second roller in a backward direction is delayed by a predetermined time period from rotation of the first roller in the backward direction. The predetermined time period is greater than a time period corresponding to one tooth of the first rotary member.

18 Claims, 13 Drawing Sheets

(51) Int. Cl.
*B65H 85/00* (2006.01)
*B65H 9/00* (2006.01)

(52) U.S. Cl.
CPC ..... *B65H 2403/72* (2013.01); *B65H 2403/73* (2013.01)

(58) Field of Classification Search
CPC ..... B65H 2403/5332; B65H 2403/484; B65H 2403/483; B65H 2403/421; B65H 2403/20; B65H 2403/11; B65H 2402/5122; B65H 2402/5121; B65H 2402/512
USPC ..... 271/186, 65, 225
See application file for complete search history.

(56) References Cited

U.S. PATENT DOCUMENTS

| | | | |
|---|---|---|---|
| 2013/0256976 | A1 | 10/2013 | Samoto et al. |
| 2015/0166279 | A1 | 6/2015 | Samoto et al. |

FOREIGN PATENT DOCUMENTS

| | | | |
|---|---|---|---|
| JP | H08-073062 | A | 3/1996 |
| JP | H10-329974 | A | 12/1998 |
| JP | 2013-203503 | A | 10/2013 |

* cited by examiner

IMAGE RECORDING APPARATUS

CROSS-REFERENCE TO RELATED APPLICATION

This application claims priority from Japanese Patent Application No. 2015-071354, filed on Mar. 31, 2015, which is incorporated herein by reference in its entirety.

TECHNICAL FIELD

Aspects described herein relate to an image recording apparatus configured to record an image on a sheet.

BACKGROUND

A known image recording apparatus comprises a first roller and a second roller disposed downstream of the first roller in a sheet conveying direction. While a trailing edge of a first sheet having an image recorded thereon is positioned between the first roller and the second roller, a subsequent sheet is fed toward the first roller so as to collide with the first roller which is stopped. This operation is performed to deskew the subsequent sheet.

SUMMARY

It may be beneficial to provide an image recording apparatus configured to accurately deskew a subsequent sheet while preventing a first sheet having an image recorded thereon from being conveyed backward.

According to one or more aspects of the disclosure, an image recording apparatus comprises a conveying motor, a first roller, a recording unit, a second roller, and a first transmission unit. The conveying motor is configured to rotate in a normal direction and in a reverse direction. The first roller is configured to be driven, by the conveying motor rotating in the normal direction and in the reverse direction, to rotate in a forward direction and in a backward direction, respectively. The first roller rotates in the forward direction conveys a sheet in a conveying direction. The recording unit is disposed downstream of the first roller in the conveying direction and configured to record an image on the sheet. The second roller is disposed downstream of the recording unit in the conveying direction and configured to convey the sheet in the conveying direction by rotating in the forward direction. The first transmission unit is configured to transmit a driving force of the conveying motor to the second roller and includes a first rotary member. The first rotary member includes a plurality of teeth formed on a circumference thereof. The first transmission unit has such play that when the conveying motor is switched from rotation in the normal direction to rotation in the reverse direction, rotation of the second roller in the backward direction is delayed by a predetermined time period from rotation of the first roller in the backward direction. The predetermined time period is greater than a time period corresponding to one tooth of the first rotary member.

According to one or more aspects of the disclosure, an image recording apparatus comprises a conveying motor, a first roller, a recording unit, a second roller, and a transmission unit. The conveying motor is configured to rotate in a normal direction and in a reverse direction. The first roller is configured to be driven, by the conveying motor rotating in the normal direction and in the reverse direction, to rotate in a forward direction and in a backward direction, respectively. The first roller rotating in the forward direction conveys a sheet in a conveying direction. The recording unit is disposed downstream of the first roller in the conveying direction and configured to record an image on the sheet. The second roller is disposed downstream of the recording unit in the conveying direction and configured to convey the sheet in the conveying direction by rotating in the forward direction. The transmission unit is configured to transmit a driving force of the conveying motor to the second roller and includes a first rotary member. The transmission unit has such play that when the conveying motor changes rotation direction from the normal direction to the reverse direction, rotation of the second roller in the backward direction is delayed by a predetermined time period from rotation of the first roller in the backward direction. The predetermined time period is greater than a time period required for the sheet to be conveyed by 2 mm in the conveying direction when the conveying motor rotates in the normal direction.

DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
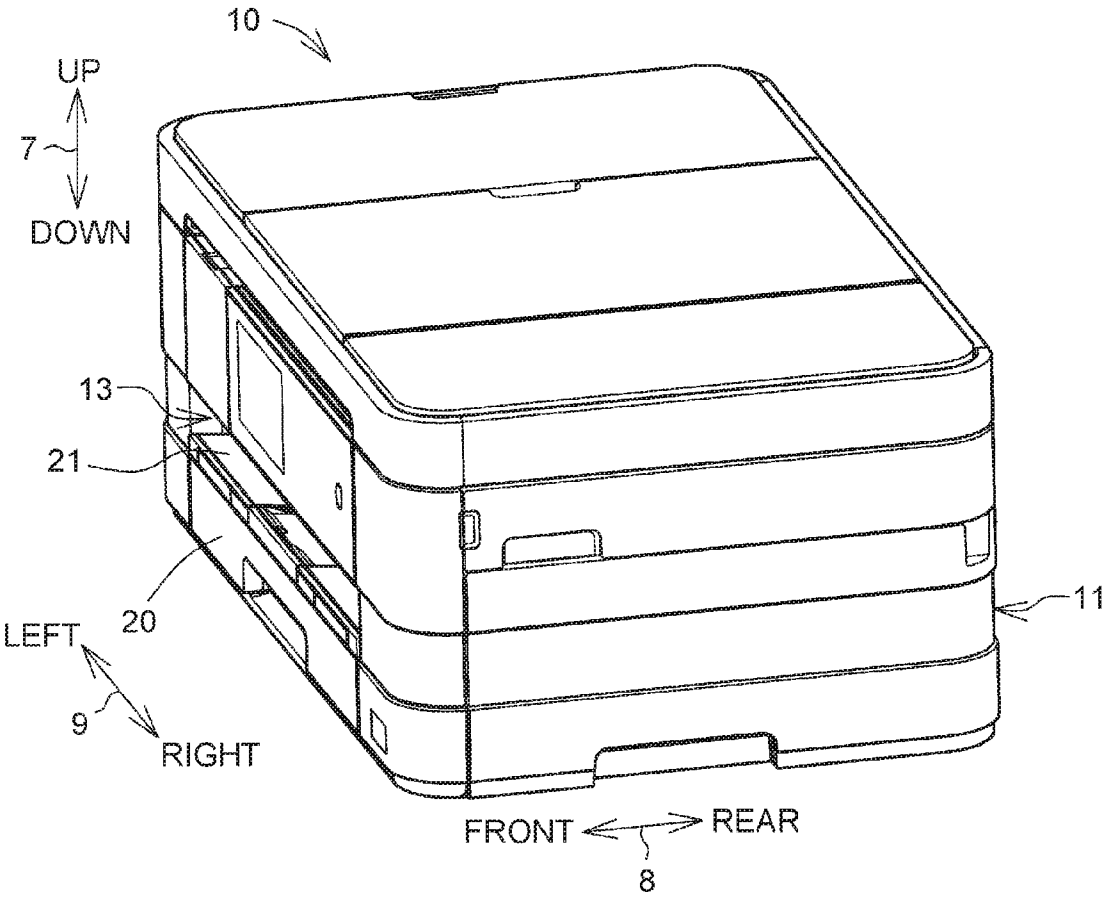
FIG. 1 is a perspective view depicting a multifunction device in an illustrative embodiment according to one or more aspects of the disclosure.

An illustrative embodiment according to one or more aspects of the disclosure will be described below. The disclosure is merely an example and various changes, arrangements and modifications may be applied therein without departing from the spirit and scope of the disclosure. An up-down direction 7 may be defined with reference to an orientation of a multifunction device 10 that may be disposed in an orientation in which it may be intended to be used (refer to FIG. 1). The side of the multifunction device 10, in which an opening 13 may be defined, may be defined as the front of the multifunction device 10. A front-rear direction 8 may be defined with reference to the front of the multifunction device 10. A right-left direction 9 may be defined with respect to the multifunction device 10 as viewed from the front of the multifunction device 10.

[Overall Configuration of Multifunction Device 10]

Figure 2:
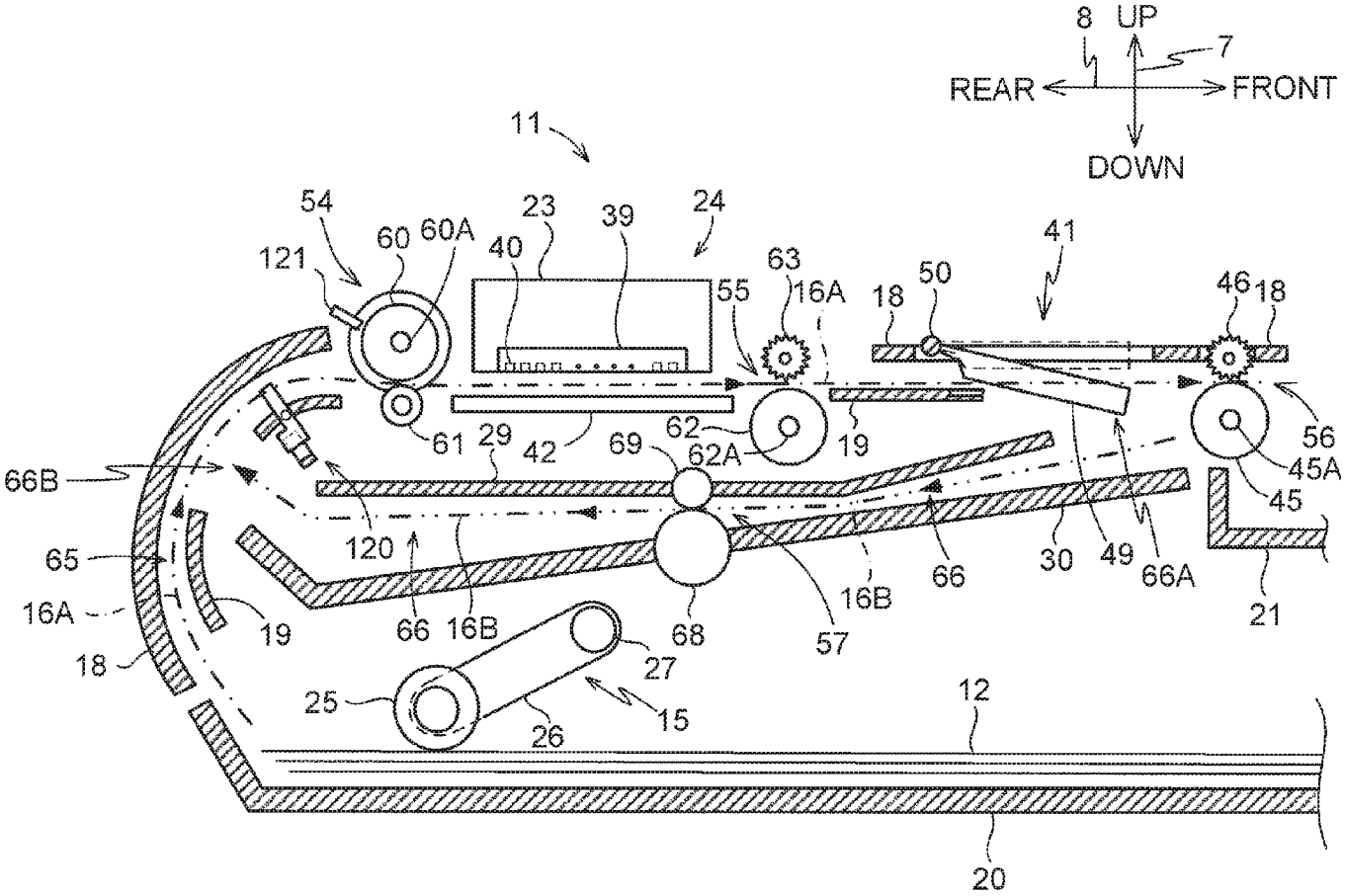
FIG. 2 is a schematic vertical sectional view depicting an internal structure of a printer unit in the illustrative embodiment according to one or more aspects of the disclosure.

As depicted in FIG. 1, the multifunction device 10 has a substantially parallelepiped shape. The multifunction device 10 includes a printer unit 11 at its lower portion. The printer unit 11 records an image onto a sheet 12 (refer to FIG. 2) using an inkjet recording method. In the illustrative embodiment, the printer unit 11 has a function of recording an image onto each side (e.g., each of first and second sides) of a sheet 12. The multifunction device 10 also has other functions, e.g., a facsimile function and a printing function. As depicted in FIG. 2, the printer unit 11 includes a feed unit 15, a feed tray 20 (as an example of a tray), a discharge tray 21, a conveying roller unit 54, a recording unit 24, a discharge roller unit 55, a platen 42, a reverse roller unit 56, and a return roller unit 57. The multifunction device 10 is an example of an image recording apparatus.

[Feed Tray 20 and Discharge Tray 21]

As depicted in FIGS. 1 and 2, the feed tray 20 is configured to be inserted into and removed from the printer unit 11 in the front-rear direction 8 through the opening 13 defined in the front of the printer unit 11. The feed tray 20 is configured to support one or more sheets 12 in a stack. The discharge tray 21 is disposed above the feed tray 20. The discharge tray 21 is configured to support one or more sheets 12 discharged thereon through the opening 13 by the discharge roller unit 55.

[Feed Unit 15]

As depicted in FIG. 2, the feed unit 15 includes a feed roller 25, an arm 26, and a shaft 27. The feed roller 25 is rotatably supported by a distal end of the arm 26. The feed roller 25 is capable of rotating in a particular direction (e.g., in a forward direction) by transmission of a driving force from a feed motor 101 (refer to FIG. 8). When the feed roller 25 rotates in the forward direction, the feed roller 25 conveys one or more sheets 12 supported by the feed tray 20, one by one, in a first conveying direction 16A (as an example of a conveying direction). Thus, the feed roller 25 feeds, one by one, one or more sheets 12 toward the conveying roller unit 54 defining a portion of a first conveying path 65. The arm 26 is rotatably supported by the shaft 27 supported by a frame of the printer unit 11. The feed roller 25 may receive a driving force from another motor, for example, a conveying motor 102 (refer to FIG. 8), instead of the feed motor 101.

[First Conveying Path 65 and Second Conveying Path 66]

As depicted in FIG. 2, the printer unit 11 includes the first conveying path 65 and a second conveying path 66 defined therein for allowing a sheet 12 to pass therethrough. The first conveying path 65 may be a space defined by guide members 18 and 19. The guide members 18 and 19 face each other and are spaced apart from each other in the printer unit 11. The first conveying direction 16A in which a sheet 12 is conveyed in the first conveying path 65 is indicated by a dot-and-dashed line with an arrow in FIG. 2.

In the illustrative embodiment, the first conveying path 65 includes a curved section and a straight section. The curved section extends curvedly upward from a rear end of the printer unit 11 and U-turns toward the front. The straight section extends substantially straight from the conveying roller unit 54 to the discharge tray 21 via the recording unit 24. In the illustrative embodiment, the discharge roller unit 55 and the reverse roller unit 56 define respective portions of the straight section of the first conveying path 65.

The second conveying path 66 (as an example of a conveying path) may be a space defined by guide members 29 and 30. The guide members 29 and 30 facing each other and are spaced apart from each other in the printer unit 11. The second conveying path 66 is used for turning over the sheet 12 whose first side has an image recorded thereon by the recording unit 24, and for guiding the turned-over sheet 12 to the conveying roller unit 54 again. In the illustrative embodiment, the second conveying path 66 branches off from the first conveying path 65 at a first point 66A and joins the first conveying path 65 again at a second point 66B. The first point 66A is located between the discharge roller unit 55 and the reverse roller unit 56 in the first conveying direction 16A. The second point 66B is located upstream of a sensor 120 in the first conveying direction 16A. A second conveying direction 16B in which a sheet 12 is conveyed in the second conveying path 66 is indicated by a double dotted-and-dashed line in FIG. 2.

[Conveying Roller Unit 54]

As depicted in FIG. 2, the conveying roller unit 54 is disposed between the sensor 120 and the recording unit 24 in the first conveying direction 16A. The conveying roller unit 54 includes a conveying roller 60 (as an example of a first roller) and a pinch roller 61 facing each other. The conveying roller 60 is driven by the conveying motor 102 (refer to FIG. 8) that is configured to rotate selectively in a normal direction and in a reverse direction. The pinch roller 61 rotates following rotation of the conveying roller 60. The conveying roller 60 is capable of rotating in a forward direction upon transmission of a driving force generated by the conveying motor 102 rotating in the normal direction. When the conveying roller 60 rotates in the forward direction, the conveying roller 60 conveys a sheet 12, which is pinched between the conveying roller 60 and the pinch roller 61, in the first conveying direction 16A. The conveying roller 60 is also capable of rotating in a backward direction upon transmission of a driving force generated by the conveying motor 102 rotating in the reverse direction. The backward direction may be reverse to the forward direction.

Figure 4:
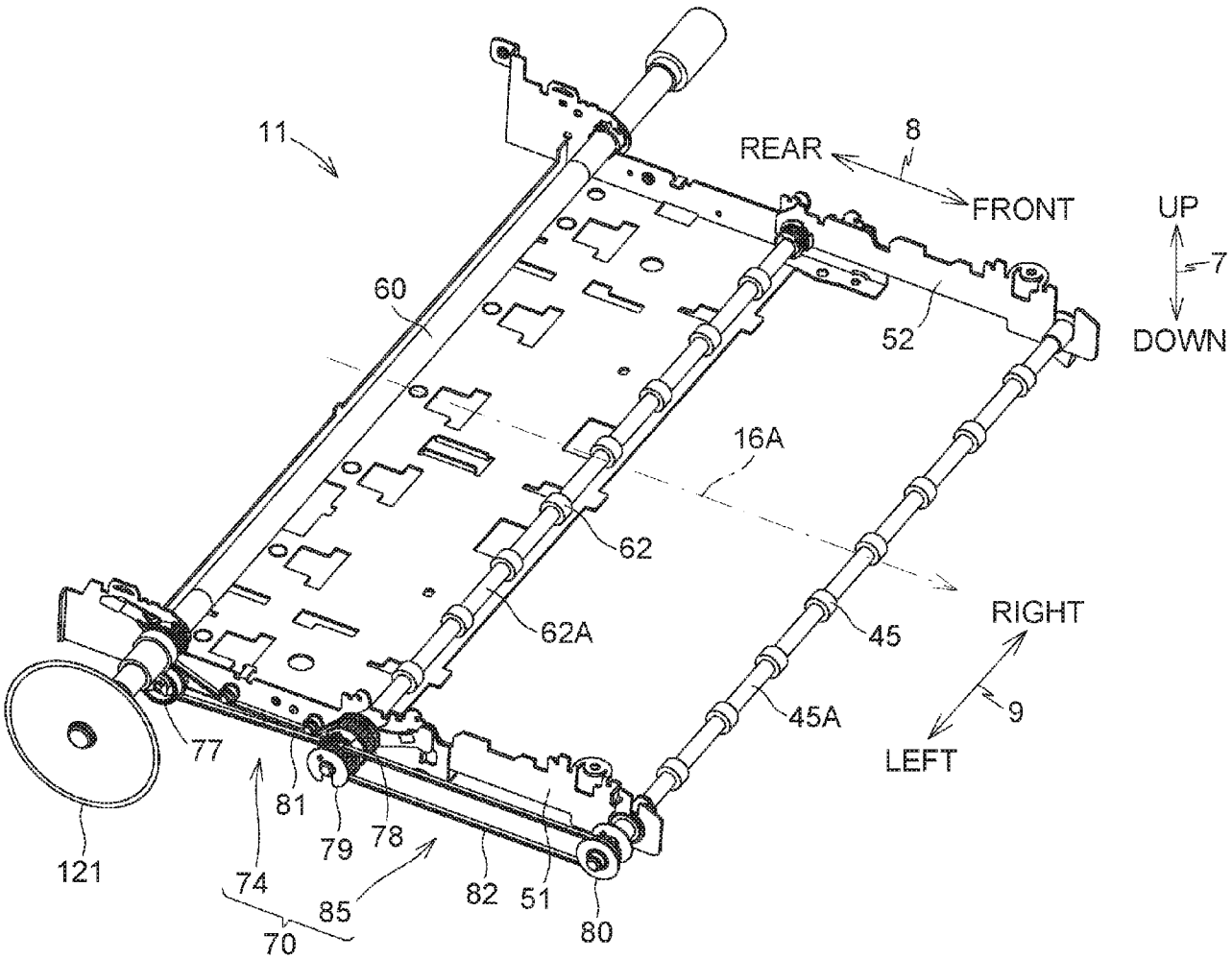
FIG. 4 is a perspective view depicting a first transmission mechanism, a conveying roller, a discharge roller, a reverse roller, and their surrounding components in the illustrative embodiment according to one or more aspects of the disclosure.

As depicted in FIG. 4, the conveying roller 60 is rotatably supported by side guides 51 and 52 at its right and left end portions in the right-left direction 9. The side guides 51 and 52 are spaced apart from each other in the right-left direction 9.

[Discharge Roller Unit 55]

As depicted in FIG. 2, the discharge roller unit 55 is disposed between the recording unit 24 and the first point 66A in the first conveying direction 16A. The discharge roller unit 55 includes a discharge roller 62 (as an example of a second roller) and a spur 63 facing each other. The discharge roller 62 is driven by the conveying motor 102 (refer to FIG. 8). The spur 63 rotates following rotation of the discharge roller 62. The discharge roller 62 is capable of rotating in a forward direction upon transmission of a driving force generated by the conveying motor 102 rotating in the normal direction. When the discharge roller 62 rotates in the forward direction, the discharge roller 62 conveys a sheet 12, which is pinched between the discharge roller 62 and the spur 63, in the first conveying direction 16A. The discharge roller 62 is also capable of rotating in a backward direction upon transmission of a driving force generated by the conveying motor 102 rotating in the reverse direction.

As depicted in FIG. 4, the discharge roller 62 is rotatably supported by the side guides 51 and 52 at its right and left end portions in the right-left direction 9.

[Reverse Roller Unit 56]

As depicted in FIG. 2, the reverse roller unit 56 is disposed downstream of the first point 66A in the first conveying direction 16A. The reverse roller unit 56 includes a reverse roller 45 (as an example of a third roller) and a spur 46. The reverse roller 45 is driven by the conveying motor 102 (refer to FIG. 8). The spur 46 rotates following rotation of the reverse roller 45. The reverse roller 45 is capable of rotating in a forward direction upon transmission of a driving force generated by the conveying motor 102 rotating in the normal direction. When the reverse roller 45 rotates in the forward direction, the reverse roller 45 conveys a sheet 12, which is pinched between the reverse roller 45 and the spur 46, in the first conveying direction 16A. The reverse roller 45 is also capable of rotating in a backward direction upon transmission of a driving force generated by the conveying motor 102 rotating in the reverse direction. The backward direction may be reverse to the forward direction. When the reverse roller 45 rotates in the backward direction, the reverse roller 45 conveys a sheet 12, which is pinched between the reverse roller 45 and the spur 46, in the second conveying direction 16B.

As depicted in FIG. 4, the reverse roller 45 is rotatably supported by the side guides 51 and 52 at its right and left end portions in the right-left direction 9.

[Return Roller Unit 57]

As depicted in FIG. 2, the return roller unit 57 is disposed between the first point 66A and the second point 66B and defines a portion of the second conveying path 66. The return roller unit 57 includes a return roller 68 and a driven roller 69 facing each other. The return roller 68 is driven by the conveying motor 102 (refer to FIG. 8). The driven roller 69 rotates following rotation of the return roller 68. The return roller 68 is capable of rotating in a particular direction (e.g., in a normal direction) upon transmission of a driving force generated by the conveying motor 102 rotating in one of the normal direction and the reverse direction. When the return roller 68 rotates in the normal direction, the return roller 68 conveys a sheet 12, which is pinched between the return roller 68 and the driven roller 69, in the second conveying direction 16B.

[Recording Unit 24]

Figure 3:
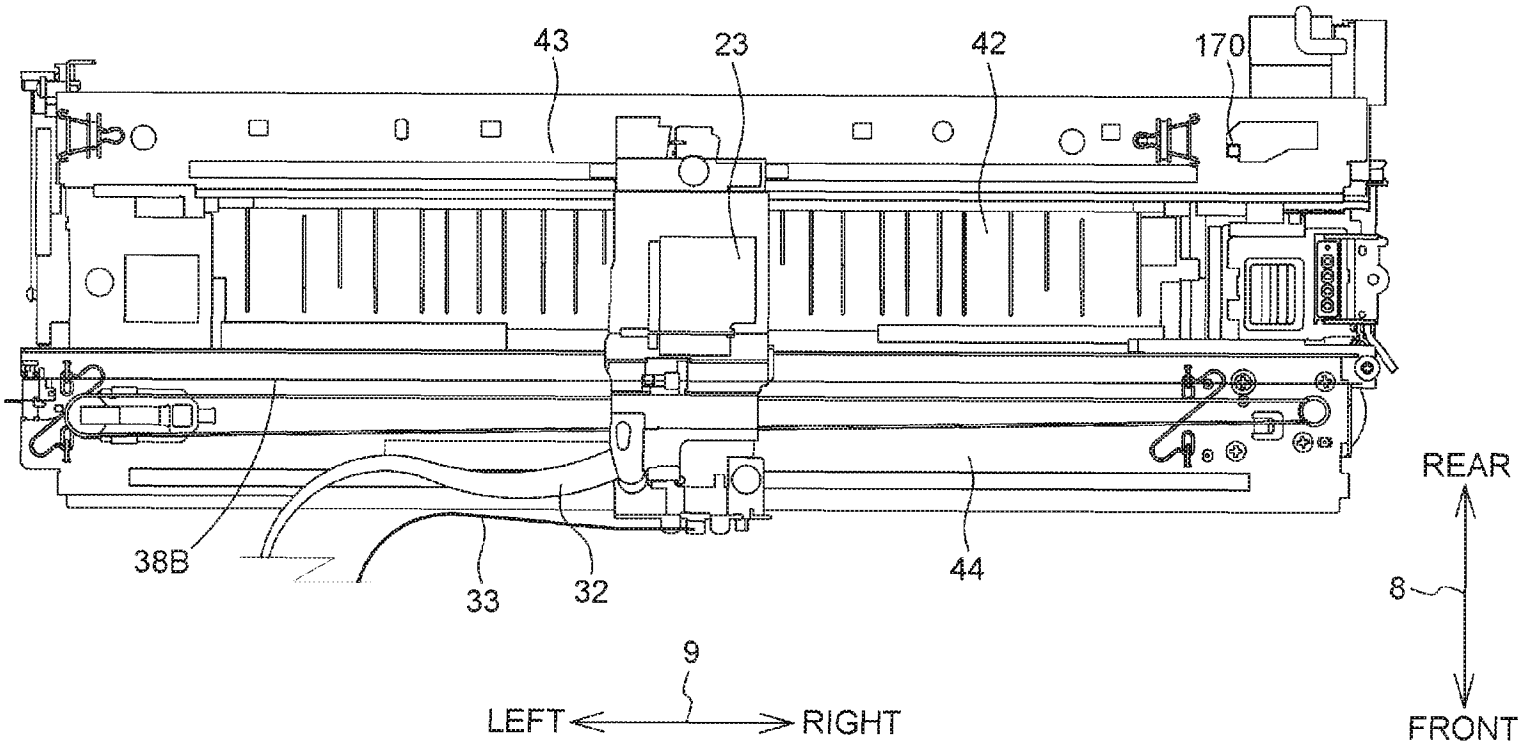
FIG. 3 is a plan view depicting a carriage and guide rails in the illustrative embodiment according to one or more aspects of the disclosure.

As depicted in FIG. 2, the recording unit 24 is disposed between the conveying roller unit 54 and the discharge roller unit 55 in the first conveying direction 16A. The recording unit 24 faces the platen 42 in the up-down direction 7. The recording unit 24 includes a carriage 23 and a recording head 39. As depicted in FIG. 3, an ink tube 32 and a flexible flat cable 33 extend from the carriage 23. The ink tube 32 supplies ink from an ink cartridge to the recording head 39. The flexible flat cable 33 connects electrically between a control board and the recording head 39. The control board is equipped with a controller 130.

As depicted in FIG. 3, the carriage 23 is supported by guide rails 43 and 44 extending in the right-left direction 9. The guide rails 43 and 44 are spaced apart from each other in the front-rear direction 8. The carriage 23 is connected to a known belt mechanism disposed at the guide rail 44. The belt mechanism is driven by a carriage motor 103 (refer to FIG. 8). For example, when the belt mechanism rotates by driving of the carriage motor 103, the carriage 23 connected to the belt mechanism is capable of reciprocating in a main scanning direction along the right-left direction 9.

As depicted in FIG. 2, the recording head 39 is mounted on the carriage 23. The recording head 39 has a plurality of nozzles 40 defined in its bottom surface. The recording head 39 ejects minute ink droplets from the nozzles 40. While the carriage 23 reciprocates in the right-left direction 9, the recording head 39 ejects ink droplets onto a sheet 12 supported by the platen 42, thereby recording an image on the sheet 12.

[Platen 42]

As depicted in FIG. 2, the platen 42 is disposed between the conveying roller unit 54 and the discharge roller unit 55 in the first conveying direction 16A. The platen 42 faces the recording unit 24 in the up-down direction 7. The platen 42 is configured to support, from below, a sheet 12 to be conveyed by the conveying roller unit 54.

[Path Switching Member 41]

As depicted in FIG. 2, the printer unit 11 includes a path switching member 41 (as an example of a guide member) at the first point 66A between the discharge roller unit 55 and the reverse roller unit 56 in the first conveying direction 16A. The path switching member 41 includes a flap 49 and a shaft 50. The flap 49 extends from the shaft 50 substantially along the first conveying direction 16A and is pivotably supported by the shaft 50. The flap 49 is pivotable about the shaft 50 between a sheet return position (e.g., a position of the flap 49 indicated by a solid line in FIG. 2) and a sheet discharge position (e.g., a position of the flap 29 indicated by a dashed line in FIG. 2). When the flap 49 is located at the sheet return position, the flap 49 blocks the first conveying path 65. When the flap 49 is located at the sheet discharge position, the flap 49 allows a sheet 12 to move along the first conveying path 65.

The flap 49 is located normally at the sheet return position by its own weight. As a sheet 12 comes into contact with the flap 49, the sheet 12 being conveyed in the first conveying direction 16A moves up the flap 49, whereby the flap 49 pivots about the shaft 50 from the sheet return position to the sheet discharge position. Thereafter, the flap 49 guides the sheet 12 being conveyed in the first conveying direction 16A. When a trailing edge of the sheet 12 (e.g., an upstream edge of the sheet 12 in the first conveying direction 16A) being conveyed in the first conveying direction 16A reaches the first point 66A, the flap 49 pivots from the sheet discharge position to the sheet return position by its own weight.

When the reverse roller unit 56 continues to rotate in the forward direction in a state where the flap 49 is located at the sheet return position, the sheet 12 is conveyed in the first conveying direction 16A and thus is discharged onto the discharge tray 21. When the rotational direction of the reverse roller unit 56 is changed to the backward direction from the forward direction, the sheet 12 is conveyed in the second conveying direction 16B along the second conveying path 66 while the upstream edge of the sheet 12 in the first conveying direction 16A leads its movement. For example, the path switching member 41 guides a sheet 12 being conveyed in a direction reverse to the first conveying direction 16A into the second conveying path 66.

[Sensor 120]

As depicted in FIG. 2, the printer unit 11 further includes the sensor 120. The sensor 12 may be a known sensor and is disposed upstream of the conveying roller unit 54 in the first conveying direction 16A. The sensor 120 is configured to detect the presence or absence of a sheet 12 at an installed position of the sensor 120. A sheet 12 conveyed by one of the feed unit 15 and the return roller unit 57 passes the installed position of the sensor 120 and then reaches the conveying roller unit 54. In response to the presence of a sheet 12 at the installed position of the sensor 120, the sensor 120 outputs a low level signal (as an example of a detection signal) to the controller 130 (refer to FIG. 8). In response to the absence of a sheet 12 at the installed position of the sensor 120, the sensor 120 outputs a high level signal (as another example of the detection signal) to the controller 130.

[Rotary Encoders 121 and 122]

Figure 8:
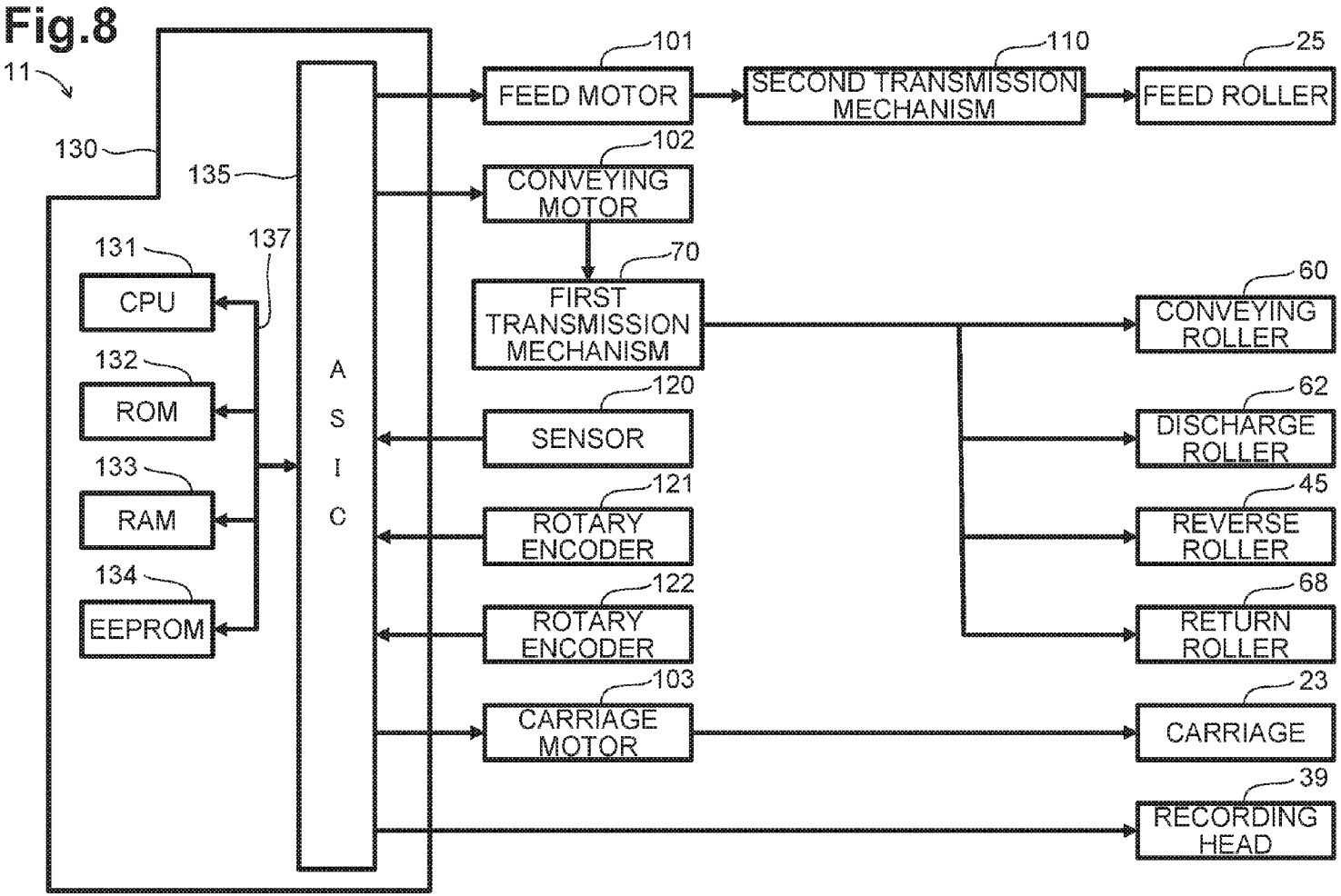
FIG. 8 is a block diagram depicting an internal configuration of the printer unit in the illustrative embodiment according to one or more aspects of the disclosure.

As depicted in FIG. 2, the printer unit 11 further includes a known rotary encoder 121 (refer to FIG. 8). The rotary encoder 121 is configured to generate a pulse signal in accordance with rotation of the conveying roller 60 (e.g., rotation of the conveying motor 102). The rotary encoder 121 includes an encoder disk and an optical sensor. The encoder disk rotates together with the conveying roller 60. The optical sensor generates a pulse signal by reading the rotating encoder disk and outputs the generated pulse signal to the controller 130.

The printer unit 11 further includes another known rotary encoder 122 (refer to FIG. 8). The rotary encoder 122 is configured to generate a pulse signal in accordance with rotation of the feed roller 25 (e.g., rotation of the feed motor 101). Similar to the rotary encoder 121, the rotary encoder 122 includes an encoder disk and an optical sensor. The encoder disk of the rotary encoder 122 rotates together with the feed roller 25. The optical sensor of the rotary encoder 122 generates a pulse signal by reading the encoder disk rotating following rotation of the feed roller 25 and outputs the generated pulse signal to the controller 130.

[First Transmission Mechanism 70]

As depicted in FIG. 8, a first transmission mechanism 70 transmits a driving force from a single motor, e.g., the conveying motor 102, to a plurality of rollers, e.g., the conveying roller 60, the discharge roller 62, the reverse roller 45, and the return roller 68. The first transmission mechanism 70 includes all or various combinations of one or more of gears, pulleys, endless belts, and a planet gear mechanism (e.g., a pendulum gear mechanism). The configuration of the first transmission mechanism 70, e.g., the number of gears included in the first transmission mechanism 70, might not be limited to the specific example described below. In the illustrative embodiment, the first transmission mechanism 70 includes an endless belt and two pulleys, in which the belt is wound around the pulleys. Nevertheless, in other embodiments, for example, the first transmission mechanism 70 may include a gear train in which a plurality of gears are in mesh with one another, instead of having the configuration of the illustrative embodiment.

Figure 9B:
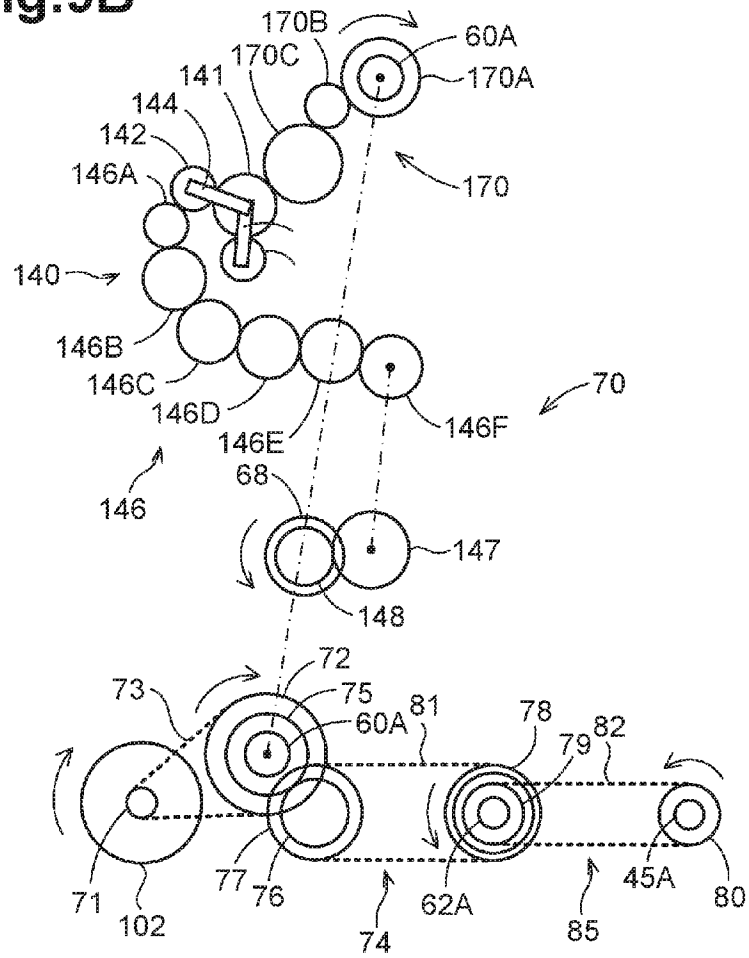
FIG. 9B is a schematic view depicting the first transmission mechanism in the illustrative embodiment according to one or more aspects of the disclosure, wherein the conveying motor is driven to rotate in a reverse direction.
Figure 9A:
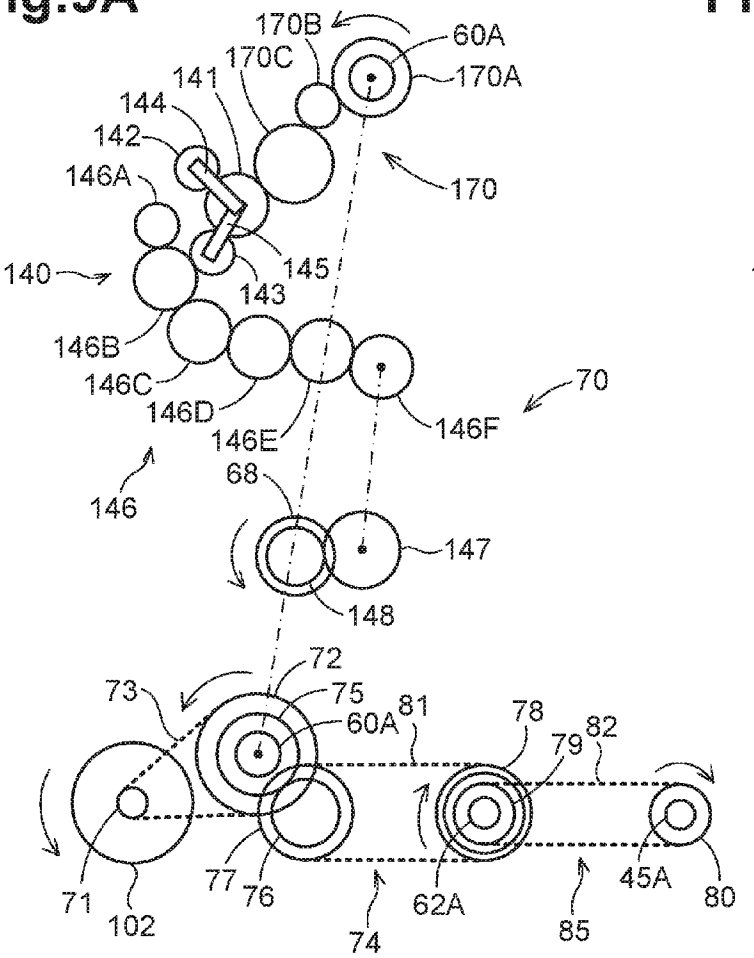
FIG. 9A is a schematic view depicting the first transmission mechanism in the illustrative embodiment according to one or more aspects of the disclosure, wherein a conveying motor is driven to rotate in a normal direction.

As depicted in FIGS. 9A and 9B, the first transmission mechanism 70 includes pulleys 71 and 72, and an endless belt 73. The pulley 71 rotates integrally with a shaft of the conveying motor 102. The pulley 72 rotates integrally with a shaft 60A of the conveying roller 60. The belt 73 is wound around the pulleys 71 and 72. With this configuration, the conveying roller 60 rotates selectively in the forward direction by transmission of a driving force generated by the conveying motor 102 rotating in the normal direction and in the backward direction by transmission of a driving force generated by the conveying motor 102 rotating in the reverse direction.

As depicted in FIGS. 4, 5, 6A, 6B, 9A, and 9B, the first transmission mechanism 70 further includes a first transmission unit 74, a second transmission unit 85, and a third transmission unit 140. The first transmission unit 74 transmits a driving force of the conveying roller 60 to the discharge roller 62. The second transmission unit 85 transmits a driving force of the discharge roller 62 to the reverse roller 45. The third transmission unit 140 transmits a driving force generated by the conveying motor 102 to the return roller 68 via the shaft 60A of the conveying roller 60.

[First Transmission Unit 74]

Figure 5:
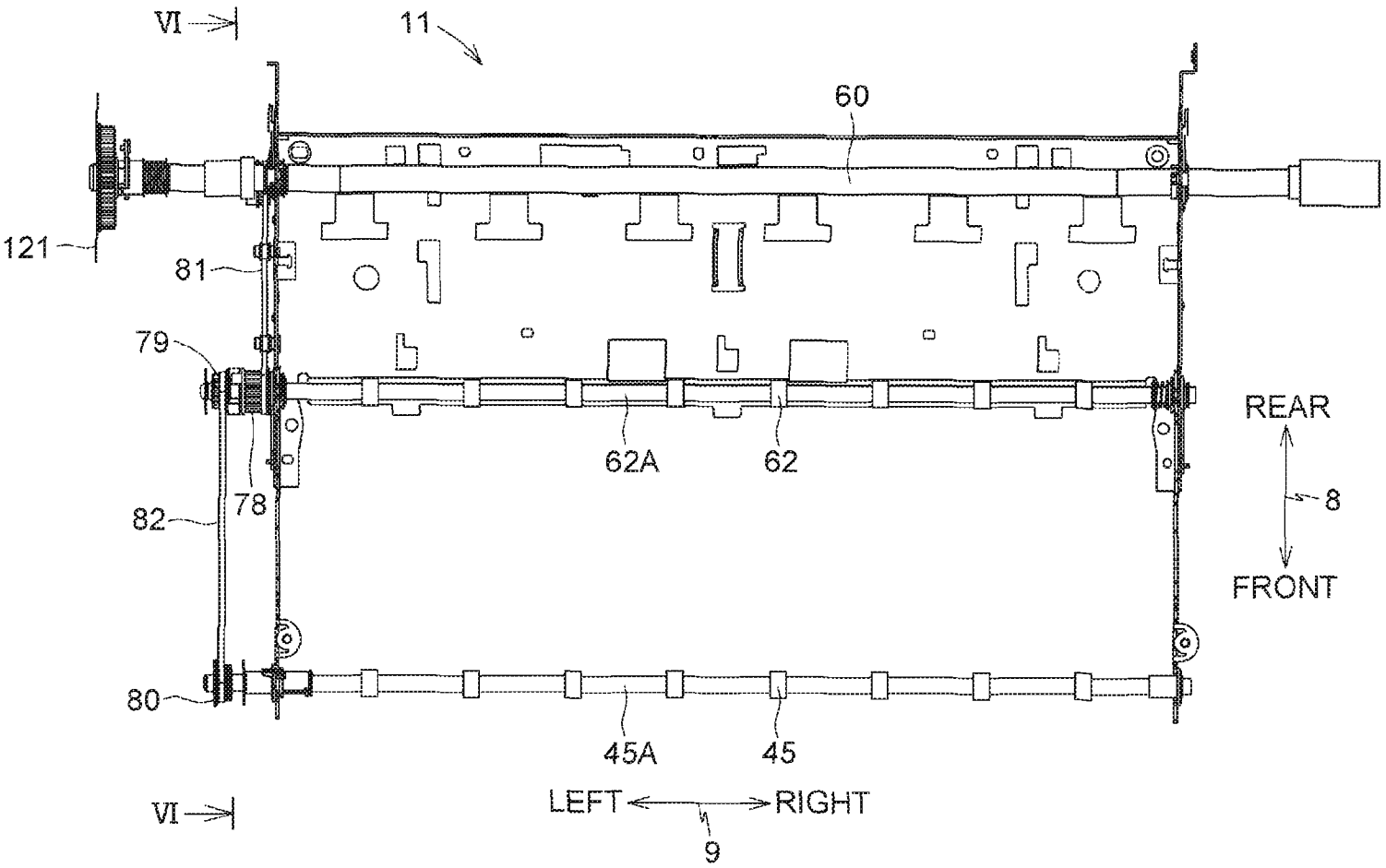
FIG. 5 is a plan view depicting the first transmission mechanism, the conveying roller, the discharge roller, the reverse roller, and their surrounding components of FIG. 4 in the illustrative embodiment according to one or more aspects of the disclosure.
Figure 6A:
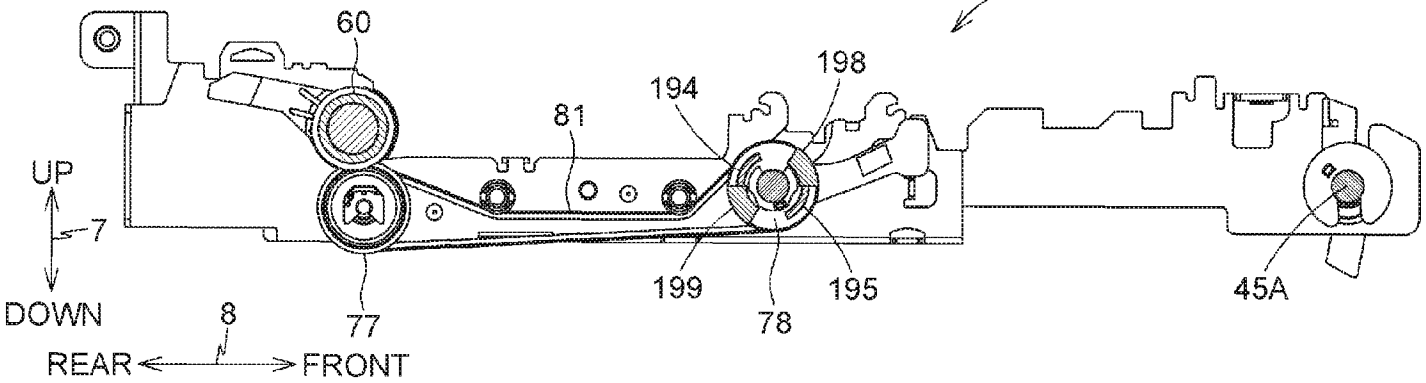
FIG. 6A is a cross-sectional view taken along line VI-VI of FIG. 5 in the illustrative embodiment according to one or more aspects of the disclosure, wherein one of protrusions of a pulley is in contact with one of protrusions of another pulley.
Figure 6B:
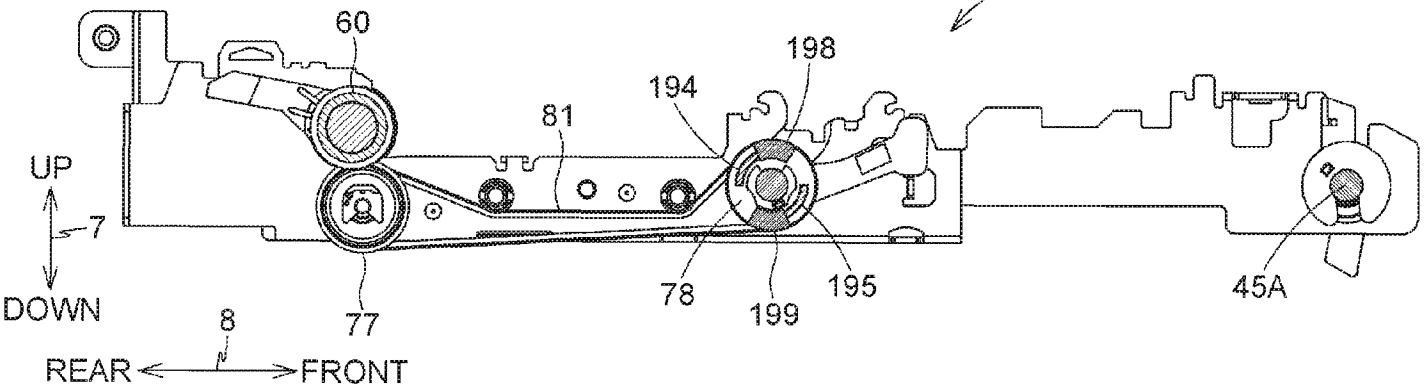
FIG. 6B is a cross-sectional view taken along line VI-VI of FIG. 5 in the illustrative embodiment according to one or more aspects of the disclosure, wherein the one of the protrusions of the pulley is in contact with the other of the protrusions of the other pulley.

As depicted in FIGS. 4 and 5, the first transmission unit 74 is disposed to the left of the side guide 51. As depicted in FIGS. 4, 5, 6A, 6B, 9A, and 9B, the first transmission unit 74 includes gears 75 and 76, pulleys 77, 78, and 79, and an endless belt 81. The gears 75 and 76 are in mesh with each other.

The gear 75 is in mesh with the gear 76 and rotates integrally with the shaft 60A (as an example of a support shaft of the first roller) of the conveying roller 60. The gear 76 and the pulley 77 (as an example of a first pulley) are coaxial with each other and rotate integrally with each other. The pulley 78 (as an example of a rotary member or a first rotary member or a second pulley) is supported so as to be rotatable on and relative to a shaft 62A (as an example of a support shaft of the second roller) of the discharge roller 62. That is, the pulley 78 is capable of rotating idly relative to the shaft 62A. The pulley 79 (as an example of a second rotary member or a third pulley) rotates integrally with the shaft 62A of the discharge roller 62. That is, the pulley 79 rotates integrally with the discharge roller 62. The pulley 79 is disposed adjacent to the pulley 78 in the right-left direction 9. In the illustrative embodiment, the pulley 79 is disposed to the left of the pulley 78. The belt 81 (as an example of a first belt) is wound around the pulleys 77 and 78.

Figure 7A:
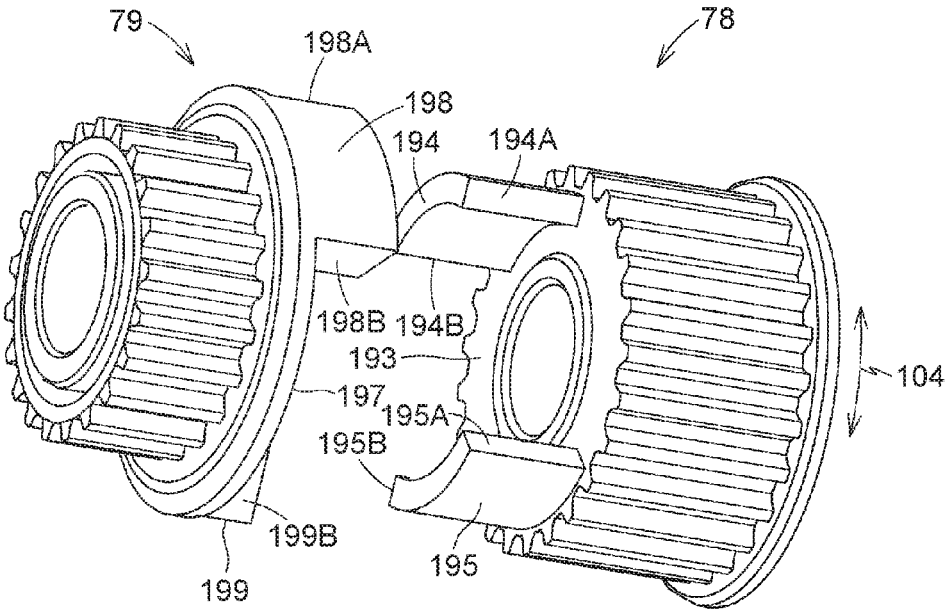
FIGS. 7A and 7B are perspective views each depicting the pulleys of FIG. 6A in the illustrative embodiment according to one or more aspects of the disclosure.
Figure 7B:
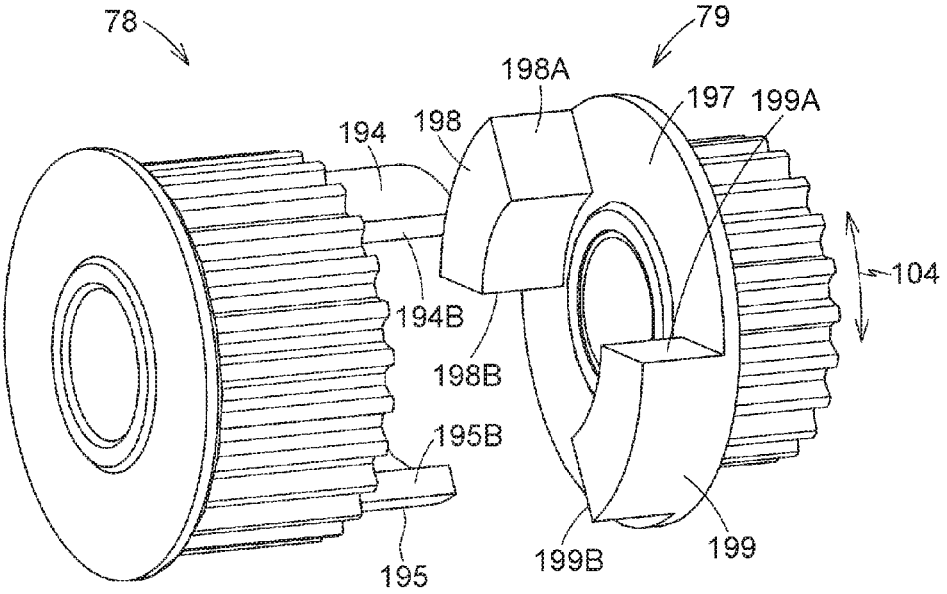

As depicted in FIGS. 7A and 7B, the pulley 78 has a surface 193 facing the pulley 79. The pulley 78 includes a plurality of, for example, two, protrusions 194 and 195 that protrude from the surface 193 toward the pulley 79. The protrusions 194 and 195 have the same dimension in a circumferential direction 104.

The protrusions 194 and 195 are spaced apart from each other in the circumferential direction 104. For example, the protrusion 194 has a side surface 194A (as an example of a first end portion) and the protrusion 195 has a side surface 195A (as an example of a second end portion), and a gap is provided between the side surface 194A of the protrusion 194 and the side surface 195A of the protrusion 195 in the circumferential direction 104. The protrusion 194 has a side surface 194B (as another example of the second end portion) opposite to the side surface 194A and the protrusion 195 has a side surface 195B (as another example of the first end portion) opposite to the side surface 195A. A gap is provided between the side surface 194B of the protrusion 194 and the side surface 195B of the protrusion 195 in the circumferential direction 104 by the same amount as the gap between the side surface 194A of the protrusion 194 and 195A of the protrusion 195 in the circumferential direction 104.

As depicted in FIGS. 7A and 7B, the pulley 79 has a surface 197 facing the pulley 78. The pulley 79 includes a plurality of, for example, two, protrusions 198 and 199 that protrude from the surface 197 toward the pulley 78. The protrusions 198 and 199 have the same dimension in the circumferential direction 104.

The protrusions 198 and 199 are spaced apart from each other in the circumferential direction 104. The protrusions 198 and 199 each have a dimension in the circumferential direction 104 that is smaller than the gap between the side surface 194A of the protrusion 194 and the protrusion 195A of the protrusion 195 (and also the gap between the side surface 194B of the protrusion 194 and the protrusion 195B of the protrusion 195) in the circumferential direction 104.

The pulley 78 and the pulley 79 are disposed with the surface 193 of the pulley 78 and the surface 197 of the pulley 79 facing each other. In this state, the protrusion 198 of the pulley 79 is located between the side surface 194A of the protrusion 194 and the side surface 195A of the protrusion 195 in the circumferential direction 104, and the protrusion 199 of the pulley 79 is located between the side surface 194B of the protrusion 194 and the side surface 195B of the protrusion 195 in the circumferential direction 104. In other words, the protrusion 194 of the pulley 78 is located between the side surface 198A (as an example of a third end portion) of the protrusion 198 and the side surface 199A (as an example of a fourth end portion) of the protrusion 199 in the circumferential direction 104, and the protrusion 195 of the pulley 78 is located between the side surface 198B (as another example of the fourth end portion) of the protrusion 198 and the side surface 199B (as another example of the third end portion) of the protrusion 199 in the circumferential direction 104.

The first transmission unit 74 transmits a driving force of the conveying roller 60 to the discharge roller 62 as described below. Referring to FIGS. 6A, 6B, 7A, 7B, and 9A, and 9B, a detailed description will be made on how the first transmission unit 74 transmits a driving force of the conveying roller 60 to the discharge roller 62.

As the conveying roller 60 rotates in its forward direction by transmission of a driving force generated by the conveying motor 102 rotating in the normal direction, a driving force of the conveying roller 60 in the forward direction is transmitted to the pulley 78 via the gears 75 and 76, the pulley 77, and the belt 81, whereby the pulley 78 rotates in its forward direction. In a case that the side surface 194A of the protrusion 194 and the protrusion 198 of the pulley 79 are in contact with each other (e.g., a state of FIG. 6B) at the time the pulley 78 starts rotating, the side surface 194A of the protrusion 194 presses the protrusion 198, whereby the pulley 79 rotates in its forward direction. That is, the pulleys 78 and 79 rotate together. Nevertheless, in other embodiments, for example, the side surface 195B of the protrusion 195 may press the protrusion 199 instead of the side surface 194A of the protrusion 194 pressing the protrusion 198, or the side surface 195B of the protrusion 195 may also press the protrusion 199 when the side surface 194A of the protrusion 194 presses the protrusion 198.

In a case that there is a gap between the side surface 194A of the protrusion 194 and the protrusion 198 of the pulley 79 at the time the pulley 78 starts rotating, the pulley 78 rotates idly relative to the pulley 79 until the side surface 194A of the protrusion 194 contacts the protrusion 198. After the side surface 194A contacts the protrusion 198, the side surface 194A presses the protrusion 198, whereby the pulley 78 rotates together with the pulley 79 in its forward direction. When the pulley 79 rotates in its forward direction, the discharge roller 62 also rotates in its forward direction.

As the conveying roller 60 rotates in its backward direction by transmission of a driving force generated by the conveying motor 102 rotating in the reverse direction, a driving force of the conveying roller 60 in the backward direction is transmitted to the pulley 78 via the gears 75 and 76, the pulley 77, and the belt 81, whereby the pulley 78 rotates in its backward direction. In a case that the side surface 194B of the protrusion 194 and the protrusion 199 of the pulley 79 are in contact with each other (e.g., a state of FIG. 6A) at the time the pulley 78 starts rotating, the side surface 194B of the protrusion 194 presses the protrusion 199, whereby the pulley 79 rotates in its backward direction. That is, the pulleys 78 and 79 rotate together. Nevertheless, in other embodiments, for example, the side surface 195A of the protrusion 195 may press the protrusion 198 instead of the side surface 194B of the protrusion 194 pressing the protrusion 199, or the side surface 195A of the protrusion 195 may also press the protrusion 198 when the side surface 194B of the protrusion 194 presses the protrusion 199.

In a case that there is a gap between the side surface 194B of the protrusion 194 and the protrusion 199 of the pulley 79 at the time the pulley 78 starts rotating, the pulley 78 rotates idly relative to the pulley 79 until the side surface 194B of the protrusion 194 contacts the protrusion 199. After the side surface 194B contacts the protrusion 199, the side surface 194B presses the protrusion 199, whereby the pulley 78 rotates together with the pulley 79 in its backward direction. When the pulley 79 rotates in its backward direction, the discharge roller 62 also rotates in its backward direction.

As described above, the pulley 78 is capable of rotating idly relative to the pulley 79 and the discharge roller 62 by a predetermined amount (e.g., an amount of the gap between the protrusion 194 and one or the other of the protrusions 198 and 199 or an amount of the gap between the protrusion 195 and one or the other of the protrusions 198 and 199 in the circumferential direction 104) and then rotating together with the pulley 79 and the discharge roller 62. That is, the pulley 78 has play of the predetermined amount relative to the pulley 79 and the discharge roller 62 in the circumferential direction 104.

In other embodiments, for example, the protrusions 194 and 195 might not necessarily have the same dimension in the circumferential direction 104. The gap (e.g., a distance) between the side surface 194A of the protrusion 194 and the side surface 195A of the protrusion 195 in the circumferential direction 104 and the gap (e.g., a distance) between the side surface 194B of the protrusion 194 and the side surface 195B of the protrusion 195 in the circumferential direction 104 might not necessarily be the same as each other. The protrusions 198 and 199 might not necessarily have the same dimension in the circumferential direction 104. The gap (e.g., a distance) between the side surface 198A of the protrusion 198 and the side surface 199A of the protrusion 199 in the circumferential direction 104 and the gap (e.g., a distance) between the side surface 198B of the protrusion 198 and the side surface 199B of the protrusion 199 in the circumferential direction 104 might not necessarily be the same as each other.

In the illustrative embodiment, each of the pulleys 78 and 79 has two protrusions. Nevertheless, the number of protrusions might not be limited to the specific example. In other embodiments, for example, the pulley 78 may have a single protrusion (e.g., the protrusion 194) and the protrusion 194 of the pulley 78 may be located between the protrusions 198 and 199 of the pulley 79.

In the illustrative embodiment, each of the pulleys 78 and 79 has two protrusions and one of the protrusions of one of the pulleys 78 and 79 is located between the protrusions of the other of the pulleys 78 and 79. Nevertheless, in other embodiments, as long as one of the protrusions of one of the pulley 78 and the pulley 79 is located between two surfaces that are spaced apart from each other in the circumferential direction 104 and are included in the other of the pulley 78 and the pulley 79, any configuration may be adopted as well as the configuration according to the illustrative embodiment.

In one example, the pulley 78 may include a single protrusion (e.g., the protrusion 194) and the pulley 79 may have a recess instead of the protrusions 198 and 199. In this case, a gap (e.g., a distance) between one surface defining the recess in the circumferential direction 104 (as another example of the first surface) and the other surface defining the recess in the circumferential direction 104 (as another example of the second surface) may be greater than the dimension of the protrusion 194 in the circumferential direction 104. The protrusion 194 of the pulley 78 may be located in the recess and between the one surface and the other surface defining the recess in the circumferential direction 104.

[Second Transmission Unit 85]

As depicted in FIGS. 4 and 5, the second transmission unit 85 is disposed to the left of the side guide 51. As depicted in FIGS. 4, 5, 9A, and 9B, the second transmission unit 85 includes a pulley 80 (as an example of a fourth pulley) and an endless belt 82 (as an example of a second belt).

The pulley 80 rotates integrally with a shaft 45A of the reverse roller 45. For example, the pulley 80 is disposed coaxial with the reverse roller 45 and rotates integrally with the reverse roller 45. The belt 82 is wound around the pulleys 79 and 80.

The second transmission unit 85 transmits a driving force of the discharge roller 62 to the reverse roller 45. Referring to FIGS. 9A and 9B, a detailed description will be made on how the second transmission unit 85 transmits a driving force of the discharge roller 62 to the reverse roller 45.

As the discharge roller 62 rotates in its forward direction, a driving force of the pulley 79 rotating integrally with the discharge roller 62 is transmitted to the pulley 80 via the belt 82, whereby the pulley 80 rotates in its forward direction. Therefore, the reverse roller 45 rotates integrally with the pulley 80 in its forward direction. A driving force of the discharge roller 62 in its backward direction is transmitted to the pulley 80 and the reverse roller 45 via the belt 82 in a similar manner to the transmission of a driving force of the discharge roller 62 in the forward direction to the pulley 80 and the reverse roller 45.

Accordingly, the reverse roller 45 rotates in its forward direction by rotation of the pulley 79 in its forward direction caused by pressing of the protrusion 198 of the pulley 79 by the side surface 194A of the pulley 78. The reverse roller 45 rotates in its backward direction by rotation of the pulley 79 in its backward direction caused by pressing of the protrusion 199 of the pulley 79 by the side surface 194B of the pulley 78.

[Third Transmission Unit 140]

As depicted in FIGS. 9A and 9B, the third transmission unit 140 includes a gear train 170, a sun gear 141, pendulum gears 142 and 143, arms 144 and 145, a gear train 146, and gears 147 and 148.

The gear train 170 includes gears 170A, 170B, and 170C, which are in mesh with one another. The gear 170A rotates integrally with the shaft 60A of the conveying roller 60.

The sun gear 141 is in mesh with the gear 170C. The pendulum gear 142 is in mesh with the sun gear 141 and is capable of meshing with and disengaging from the gear 146A. The pendulum gear 143 is in mesh with the sun gear 141 and is capable of meshing with and disengaging from the gear 146B. The arm 144 includes one end and the other end. The one end of the arm 144 is supported by the sun gear 141 while the sun gear 141 is able to rotate on its axis. The other end of the arm 144 supports the pendulum gear 142 such that the pendulum gear 142 is able to rotate on its axis and around the sun gear 141. The arm 145 includes one end and the other end. The one end of the arm 145 is supported by the sun gear 141 while the sun gear 141 is able to rotate on its axis. The other end of the arm 145 supports the pendulum gear 143 such that the pendulum gear 143 is able to rotate on its axis and around the sun gear 141. The gear train 146 includes gears 146A, 146B, 146C, 146D, 146E, and 146F, which are in mesh with one another. The gear 147 is disposed coaxial with the gear 146F and rotates integrally with the gear 146F. The gear 148 is in mesh with the gear 147. The gear 148 is disposed coaxial with a shaft of the return roller 68 and rotates integrally with the return roller 68.

As depicted in FIG. 9A, upon transmission of a driving force generated by the conveying motor 102 rotating in the normal direction to the sun gear 141, the pendulum gear 142 separates from the gear 146A and the pendulum gear 143 comes into mesh with the gear 146B. For example, the driving force generated by the conveying motor 102 rotating in the normal direction is transmitted to the return roller 68 via the gears 146B, 146C, 146D, 146E, and 146F. As depicted in FIG. 9B, upon transmission of a driving force generated by the conveying motor 102 rotating in the reverse direction to the sun gear 141, the pendulum gear 143 separates from the gear 146B and the pendulum gear 142 comes into mesh with the gear 146A. For example, the driving force generated by the conveying motor 102 rotating in the reverse direction is transmitted to the return roller 68 via the gears 146A, 146B, 146C, 146D, 146E, and 146F. Therefore, the third transmission unit 140 causes the return roller 68 to rotate in the forward direction by either one of the driving force generated by the conveying motor 102 rotating in the normal direction and the driving force generated by the conveying motor 102 rotating in the reverse direction. That is, the return roller 68 rotates in the forward direction irrespective of the rotating direction of the conveying motor 102.

[Second Transmission Mechanism 110]

Figure 10A:
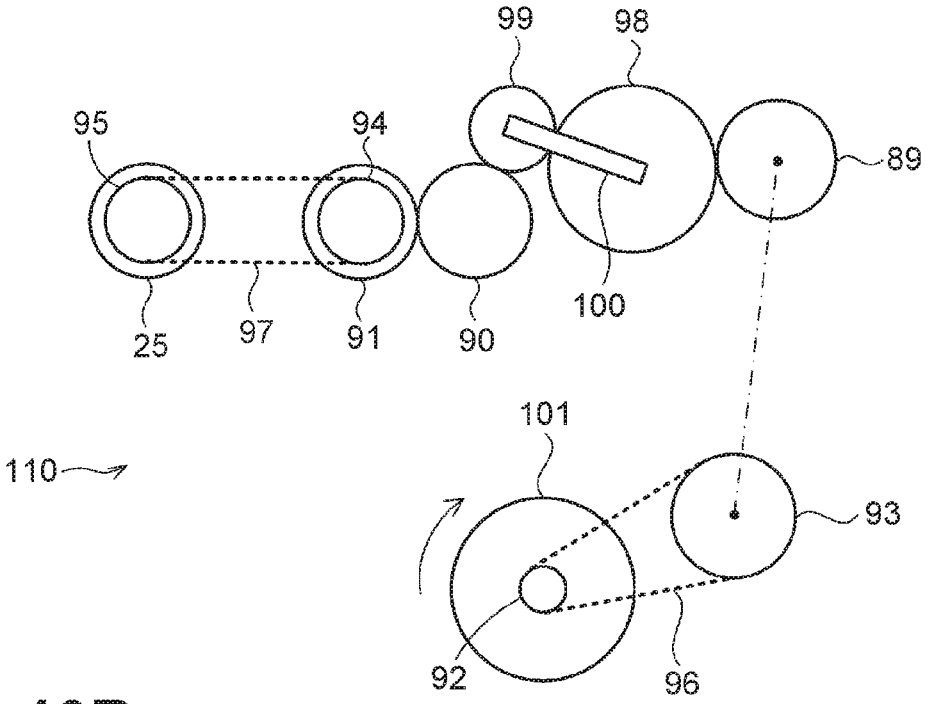
FIG. 10A is a schematic view depicting a second transmission mechanism in the illustrative embodiment according to one or more aspects of the disclosure, wherein a feed motor is driven to rotate in a reverse direction.
Figure 10B:
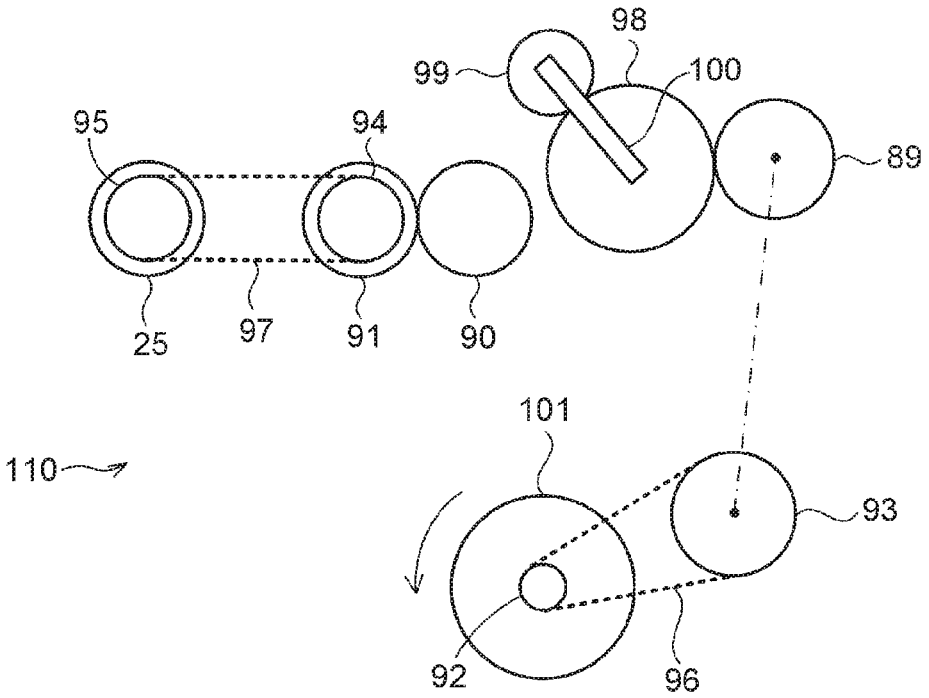
FIG. 10B is a schematic view depicting the second transmission mechanism in the illustrative embodiment according to one or more aspects of the disclosure, wherein the feed motor is driven to rotate in a normal direction.

As depicted in FIGS. 10A and 10B, the second transmission mechanism 110 transmits a driving force generated by the feed motor 101 to the feed roller 25. The second transmission mechanism 110 includes gears 89, 90, and 91, pulleys 92, 93, 94, and 95, endless belts 96 and 97, a sun gear 98, a pendulum gear 99, and an arm 100. The configuration of the second transmission mechanism 110, e.g., the number of gears included in the second transmission mechanism 110, might not be limited to the specific example described below. In the illustrative embodiment, the second transmission mechanism 110 includes an endless belt and pulleys, in which the belt is wound around the pulleys. Nevertheless, in other embodiments, for example, the second transmission mechanism 110 may include a gear train in which a plurality of gears are in mesh with one another, instead of having the configuration of the illustrative embodiment.

The pulley 92 rotates integrally with a shaft of the feed motor 101. The belt 96 is wound around the pulleys 92 and 93. The gear 89 and the pulley 93 are coaxial with each other and rotate integrally with each other. The sun gear 98 is in mesh with the gear 89. The pendulum gear 99 is in mesh with the sun gear 98 and is capable of meshing with and disengaging from the gear 90. The arm 100 includes one end and the other end. The one end of the arm 100 is supported by the sun gear 98 while the sun gear 141 is able to rotate on its axis. The other end of the arm 100 supports the pendulum gear 99 such that the pendulum gear 99 is able to rotate on its axis and around the sun gear 98. The gear 90 is in mesh with the gear 91. The gear 91 and the pulley 94 are coaxial with each other and rotate integrally with each other. The pulley 95 and the feed roller 25 are coaxial with each other and rotate integrally with each other. The belt 97 is wound around the pulleys 94 and 95.

The pendulum gear 99 rotates around the sun gear 98 while rotating on its own axis by rotation of the sun gear 98. As depicted in FIG. 10B, upon transmission of a driving force generated by the conveying motor 102 rotating in the reverse direction to the sun gear 98, the pendulum gear 99 separates from the gear 90. As depicted in FIG. 10A, upon transmission of a driving force generated by the conveying motor 102 rotating in the normal direction to the sun gear 98, the pendulum gear 99 comes into mesh with the gear 90. Therefore, while the second transmission mechanism 110 does not transmit a driving force generated by the feed motor 101 rotating in the reverse direction to the feed roller 25, the second transmission mechanism 110 causes the feed roller 25 to rotate in the forward direction by a driving force generated by the feed motor 101 rotating in the normal direction.

[Controller 130]

As depicted in FIG. 8, the controller 130 includes a control processing unit ("CPU") 131, a read-only memory ("ROM") 132, a random-access memory ("RAM") 133, an electrically erasable programmable ROM ("EEPROM") 134, and an application specific integrated circuit ("ASIC") 135, which are connected to each other via an internal bus 137. The ROM 132 stores various control programs to be used by the CPU 131 for controlling various processing. The RAM 133 may be used as a storage area for temporality storing signals and data used during execution of the programs by the CPU 131 or as a workspace for processing data. The EEPROM 134 stores settings and flags that are required to be maintained after power of the multifunction device 10 is turned off.

The feed motor 101, the conveying motor 102, and the carriage motor 103 are connected to the ASIC 135. The ASIC 135 generates a drive signal for rotating each of the feed motor 101, the conveying motor 102, and the carriage motor 103 and controls each of the feed motor 101, the conveying motor 102, and the carriage motor 103 using the generated drive signal. Each of the feed motor 101, the conveying motor 102, and the carriage motor 103 rotates selectively in the normal direction and in the reverse direction in accordance with a drive signal transmitted from the ASIC 135. For example, the controller 130 controls the feed motor 101 to drive the feed roller 25. The controller 130 controls the conveying motor 102 to drive the conveying roller 60, the discharge roller 62, the reverse roller 45, and the return roller 68. The controller 130 controls the carriage motor 103 to reciprocate the carriage 23. The controller 130 controls the recording head 39 to cause the nozzles 40 to eject ink therefrom.

The sensor 120 and the rotary encoders 121 and 122 are also connected to the ASIC 135. The controller 130 detects the presence or absence of a sheet 12 at the installed position of the sensor 120 based on a detection signal outputted from the sensor 120. The controller 130 determines a position of a sheet 12 based on a detection signal outputted from the sensor 120 and a pulse signal outputted from at least one of the rotary encoders 121 and 122.

[Image Recording]

Figure 11:
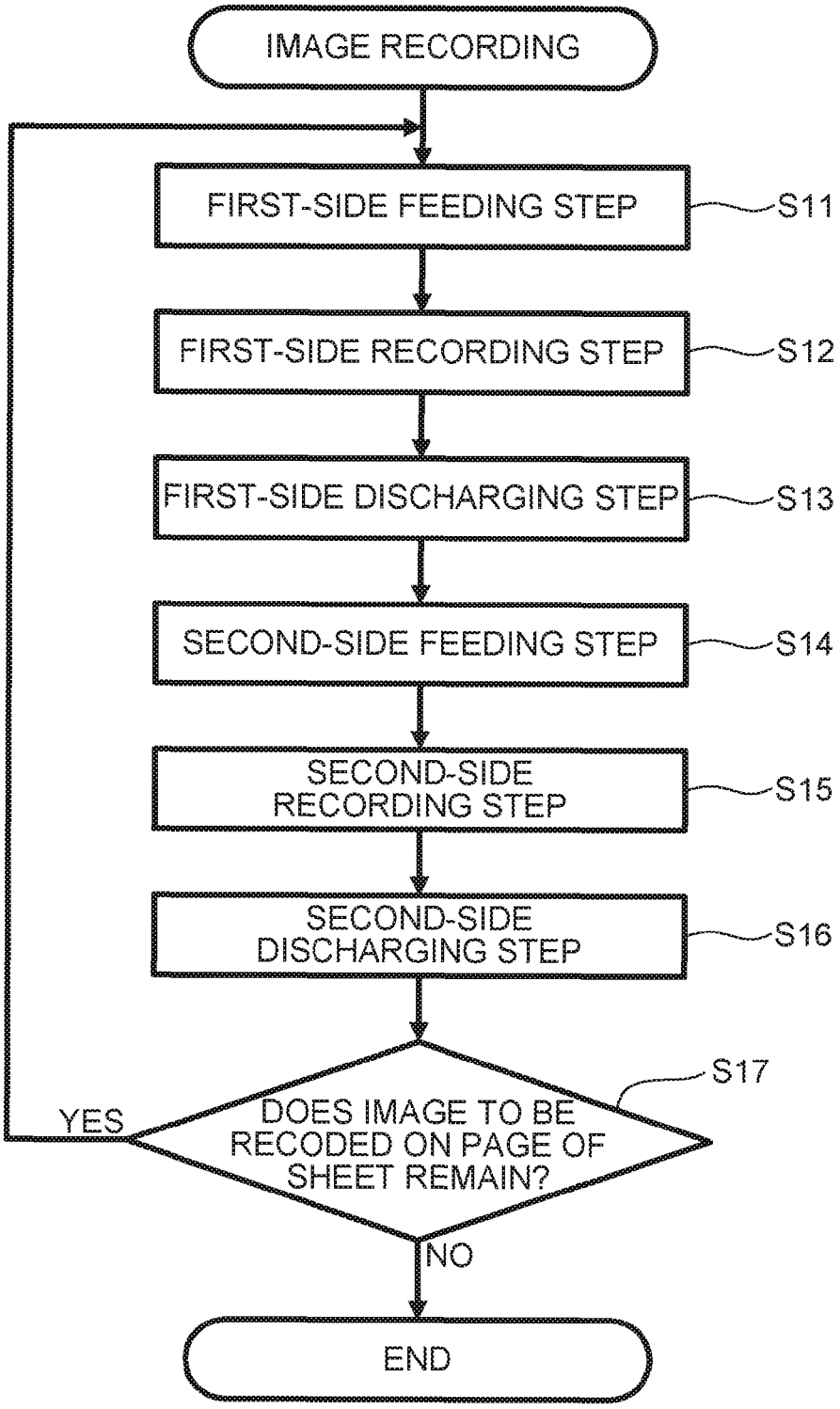
FIG. 11 is a flowchart depicting example image recording in which an image is recorded on each of first and second sides of a sheet in the illustrative embodiment according to one or more aspects of the disclosure.
Figure 12:
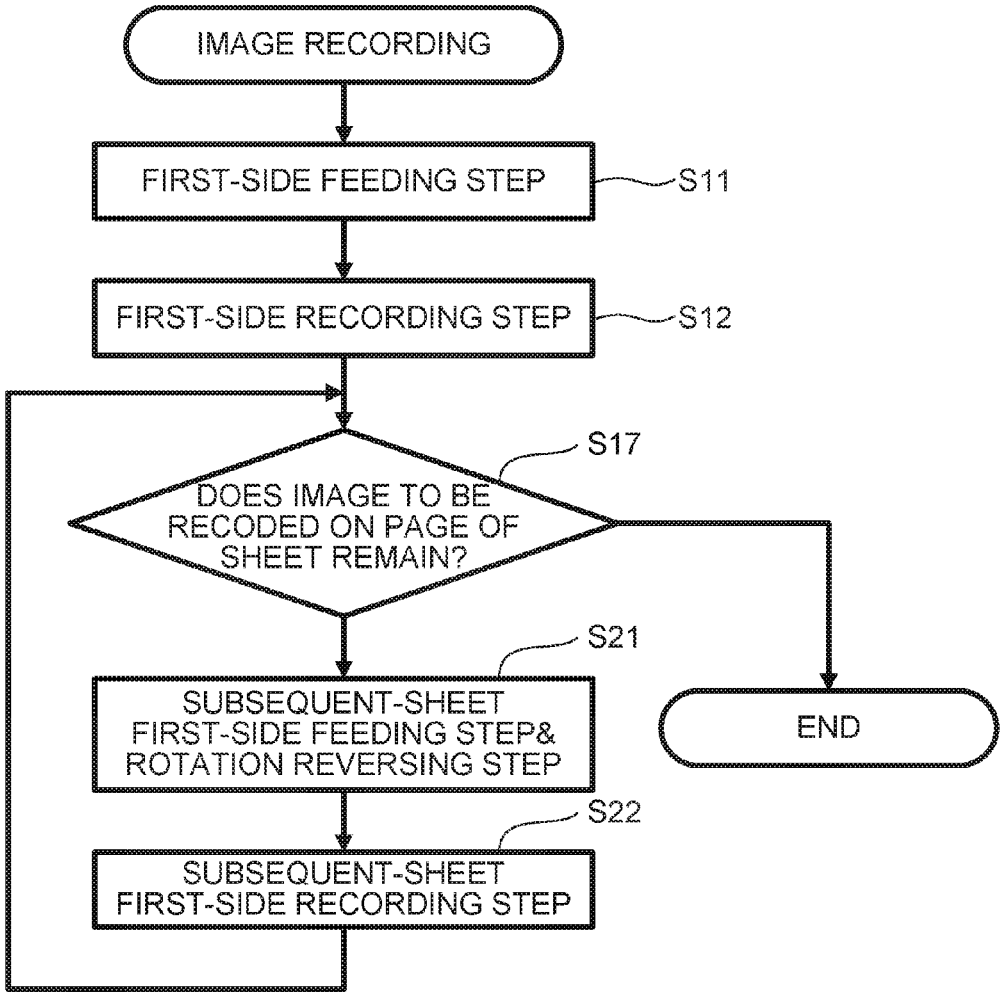
FIG. 12 is a flowchart depicting another example image recording in which an image is recorded on a first side of a sheet only in the illustrative embodiment according to one or more aspects of the disclosure.

Referring to FIGS. 11 and 12, image recording according to the illustrative embodiment will be described. In image recording, an image is recorded on one or each side of each sheet 12. The image recording is executed by the CPU 131 of the controller 130. Each step of the image recording may be executed by the CPU 131 or by a hardware circuit mounted on the controller 130. In a case that the CPU 131 executes the image recording, the CPU 131 reads the programs from the ROM 132 to execute the image recording.

In response to a recording instruction from a user, the controller 130 executes image recording. A transmission source of the recording instruction might not be limited to a particular source. For example, the controller 130 may receive a recording instruction through an operation unit of the multifunction device 10 or from an external device through a communication network. The controller 130 controls each of the rollers, the carriage 23, and the recording head 39 in accordance with the received recording instruction to record an image onto one or each side of a sheet 12.

Hereinafter, a sheet 12 on which an image is to be recorded prior to a subsequent sheet 12 may be referred to as a "first sheet 12", and another sheet 12 on which an image is to be recorded subsequent to the first sheet 12 may be referred to as a "subsequent sheet 12".

Referring to FIG. 11, image recording in which an image is recoded on each of first and second sides of each sheet 12 will be described.

First, the controller 130 executes a first-side feeding step on a first sheet 12 (e.g., step S11). In the first-side feeding step, a leading edge of the first sheet 12 (e.g. a downstream edge of the first sheet 12 in the first conveying direction 16A) supported by the feed tray 20 is made to reach the conveying roller unit 54. More specifically, the controller 130 rotates the feed motor 101 in the normal direction to cause the feed roller 25 to rotate in the forward direction.

Subsequent to step S11, the controller 130 executes a first-side recording step on the first sheet 12 (e.g., step S12). In the first-side recording step, an image is recorded onto a first side of the first sheet 12. For example, the controller 130 repeats a conveyance step and an ink ejection step alternately. In the conveyance step, the controller 130 causes at least one of the conveying roller unit 54, the discharge roller unit 55, and the reverse roller unit 56 to convey the first sheet 12 that has reached the conveying roller unit 54, by a predetermined line feed width in the first conveying direction 16A. In the ink ejection step, the controller 130 causes the recording head 39 to eject ink onto the first sheet 12 that has conveyed by the predetermined line feed width.

For example, in the conveyance step, the controller 130 rotates the conveying motor 102 in the normal direction to cause the conveying roller unit 54, the discharge roller unit 55, and the reverse roller unit 56 to each rotate in the forward direction. In the ink ejection step, the controller 130 drives the carriage motor 103 to reciprocate the carriage 23 in the right-left direction 9 and to cause the recording head 39 to eject ink therefrom at predetermined timings.

Subsequent to step S12, the controller 130 executes a first-side discharging step on the first sheet 12 (e.g., step S13). In the first-side discharging step, the controller 13 causes at least one of the conveying roller unit 54, the discharge roller unit 55, and the reverse roller unit 56 to convey, in the first conveying direction 16A, the first sheet 12 having an image on its first side until a trailing edge of the first sheet 12 (e.g., an upstream edge of the first sheet 12 in the first conveying direction 16A) reaches the first point 66A. For example, the controller 130 rotates the conveying motor 102 in the normal direction to cause the conveying roller unit 54, the discharge roller unit 55, and the reverse roller unit 56 to each rotate in the forward direction.

Subsequent to step S13, the controller 130 executes a second-side feeding step (e.g., step S14). In the second-side feeding step, the first sheet 12 having the image on its first side is turned over and is made to reach the conveying roller unit 54 again. For example, the controller 130 rotates the conveying motor 102 in the reverse direction to cause the reverse roller unit 56 to rotate in the backward direction and the return roller unit 57 to rotate in the forward direction. Thus, the first sheet 12 moves into the second conveying path 66 from the first point 66A while the upstream edge of the first sheet 12 in the first conveying direction 16A leads its movement, and reaches the conveying roller unit 54 via the second point 66B.

Subsequent to step S14, the controller 130 executes a second-side recording step on the first sheet 12 (e.g., step S15). In the second-side recording step, an image is recoded on a second side of the first sheet 12. A detail of the second-side recording step is the same or similar to the first-side recording step, and therefore, a detailed description of the second-side recording step will be omitted.

Subsequent to step S15, the controller 130 executes a second-side discharging step (e.g., step S16). In the second-side discharging step, the controller 130 causes the discharge roller unit 55 and the reverse roller unit 56 to convey the first sheet 12 in the first conveying direction 16A until the first sheet 12 passes the reverse roller unit 56 (i.e., until the first sheet 12 is discharged onto the discharge tray 21). For example, the controller 130 rotates the conveying motor 102 in the normal direction to cause the conveying roller unit 54, the discharge roller unit 55, and the reverse roller unit 56 to each rotate in the forward direction.

Subsequent to step S16, the controller 130 determines whether all of one or more images instructed by the recording instruction have been recorded on one or both pages (e.g., only a first side or each of first and second sides) of one or more sheets 12 subjected to the image recording according to the recording instruction (e.g., step S17). When the controller 130 determines that no image remains to be recoded on a page of a sheet 12 (e.g., NO in step S17), the controller 130 ends the image recording. When the controller 130 determines that an image still remains to be recoded on a page of a sheet 12 (e.g., YES in step S17), the controller 130 executes steps S11 to S16 on a subsequent sheet 12.

Referring to FIG. 12, image recording in which an image is recoded on only a first side of each sheet 12 will be described. In the description below, steps different from the steps of FIG. 11 will be described in detail and steps common to the steps of FIG. 11 will be omitted or briefly described.

The controller 130 executes a first-side feeding step (e.g., step S11) and then a first-side recording step (e.g., step S12) on a first sheet 12. The first-side feeding step is an example of a first feeding step. The first-side recording step is an example of a recording step. The controller 130 executes a conveyance step during the first-side recording step such that a trailing edge of the first sheet 12 is located between the conveying roller unit 54 and the discharge roller unit 55 in first conveying direction 16A at the end of the first-side recording step.

Subsequent to step S12, the controller 130 determines whether all of one or more images instructed by the recording instruction have been recorded on one page (i.e., one side) of one or more sheets 12 subjected to the image recording according to the recording instruction (e.g., step S17). When the controller 130 determines that no image remains to be recoded on a page of a sheet 12 (e.g., NO in step S17), the controller 130 ends the image recording.

When the controller 130 determines that an image still remains to be recoded on a page of a sheet 12 (e.g., YES in step S17), the controller 130 executes a subsequent-sheet first-side feeding step (e.g., step S21). In the subsequent-sheet first-side feeding step, a leading edge of a subsequent sheet 12 supported by the feed tray 20 is made to reach the conveying roller unit 54. For example, the controller 130 rotates the feed motor 101 in the normal direction to cause the feed roller 25 to rotate in the forward direction. The subsequent-sheet first-side feeding step is an example of a second feeding step.

The controller 130 executes a rotation reversing step at a predetermined timing during the subsequent-sheet first-side feeding step (e.g., step S21).

The predetermined timing corresponds to a timing at which a distance in the first conveying direction 16A between the leading edge of the subsequent sheet 12 and a contact portion of the conveying roller 60 where the leading edge of the subsequent sheet 12 comes into contact with the conveying roller 60 becomes a first distance which is less than a distance corresponding to the play (e.g., the gap between the protrusion 194 and one or the other of the protrusions 198 and 199 or the gap between the protrusion 195 and one or the other of the protrusions 198 and 199 in the circumferential direction 104).

In the rotation reversing step, the controller 130 rotates the conveying motor 102 in the reverse direction to cause the pulley 78 to rotate in the backward direction. At that time, the pulley 78 is rotated by an amount that is greater than an amount corresponding to the first distance and less than an amount corresponding to the play.

Until the rotation reversing step is executed, the conveying motor 102 is driven to rotate in the normal direction in the conveyance step of the first-side recording step. Thus, at the beginning of the rotation reversing step, the side surface 194A of the protrusion 194 of the pulley 78 and the protrusion 198 of the pulley 79 are in contact with each other. When the pulley 78 rotates in the backward direction by the amount that is less than the amount corresponding to the play in this state, the pulley 78 rotates idly relative to the pulley 79. Therefore, a driving force generated by the conveying motor 102 rotating in the reverse direction is not transmitted to the discharge roller 62 nor the reverse roller 45. Accordingly, in the rotation reversing step, while the conveying roller 60 rotates in the backward direction, the discharge roller 62 and the reverse roller 45 do not rotate in any direction, whereby the first sheet 12 is not conveyed in the rotation reversing step.

The pulley 78 is rotated in the backward direction by the amount that is greater than the distance corresponding to the first distance and less than the amount corresponding to the play. In the illustrative embodiment, the rotating amount of the pulley 78 and the rotating amount of the conveying roller 60 may be the same. For example, a gear ratio between the gear 75 and the gear 76 disposed in a driving force transmission route between the conveying roller 60 and the pulley 78 may be 1:1. Thus, the conveying roller 60 is also rotated in the backward direction by an amount that is greater than the amount corresponding to the first distance and less than the amount corresponding to the play. Therefore, the conveying roller 60 continues to rotate in the backward direction after the leading edge of the subsequent sheet 12 contacts the conveying roller 60. Accordingly, skew of the subsequent sheet 12 is corrected by the conveying roller 60 rotating in the backward direction.

Subsequent to step S21, the controller 130 executes a subsequent-sheet first-side recording step on the subsequent sheet 12 (e.g., step S22). Step S22 may be the same or similar to step S12. Therefore, while an image is recorded on the subsequent sheet 12, the first sheet 12 is conveyed in the first conveying direction 16A and thus discharged onto the discharge tray 21 in the conveyance step of the subsequent-sheet first-side recording step.

Subsequent to step S22, until all of the one or more instructed images are recorded on a page (e.g., a first side) of one or more sheets 12 subjected to the image recording according to the recording instruction (e.g., NO in step S17), the controller 130 executes steps S21 and S22 repeatedly on one or more subsequent sheets 12.

In the rotation reversing step during the above-described subsequent-sheet first-side feeding step (e.g., step S21), in order to register the subsequent sheet 12 accurate enough to deskew the subsequent sheet 12, it is required to continue to convey the subsequent sheet 12 after the leading edge thereof is determined to contact the conveying roller 60 which is rotating in the backward direction.

In the above-described illustrative embodiment, when the conveying motor 60 is switched from rotation in the normal direction to rotation in the reverse direction, rotation of the discharge roller 62 in the backward direction is delayed by a predetermined time period from rotation of the conveying roller 60 in the backward direction because of a play provided between the pulleys 78 and 79. The predetermined time period may be greater than a time period required for the subsequent sheet 12 to be conveyed by 2 mm (millimeters) in the first conveying direction 16A by the conveying roller 60 rotating in the forward direction. This may allow the subsequent sheet 12 to be registered accurately enough to the conveying roller 60 while preventing the first sheet 12 from conveying backward.

Further, in the illustrative embodiment, the pulley 78 may include a plurality of teeth formed on a circumference thereof, and the play between the pulleys 78 and 79 may be set such that the predetermined time period is greater than a time period corresponding to one tooth of the pulley 78.

In other embodiments, for example, the rotation reversing step may also be executed during the first-side feeding step (e.g., step S11) of FIG. 12 as well as during the subsequent-sheet first-side feeding step (e.g., step S21). In still other embodiments, the rotation reversing step may be executed during image recording in which an image is recoded on each of first and second sides of a sheet 12. In this case, for example, the rotation reversing step may be executed during the first-side feeding step (e.g., step S11) in FIG. 11 and/or during the second-side feeding step (e.g., step S14) in FIG. 11.

[Effects Obtained by Illustrative Embodiment]

According to the illustrative embodiment, the conveying roller 60 may be allowed to rotate in the backward direction by an amount corresponding to the play provided between the pulley 78 and the discharge roller 62 in the circumferential direction 104 while rotation of the discharge roller 62 is stopped. Therefore, while this configuration reduces or prevents the discharge roller 62 from conveying a first sheet 12 backward, this configuration may enable an accurate skew correction of a subsequent sheet 12 by contacting the subsequent sheet 12 to the conveying roller 60 rotating in the backward direction.

Rotation of the conveying roller 60 by an amount that is greater than an amount corresponding to the play may enable transmission of a driving force of the conveying roller 60 to the discharge roller 62. Thus, the discharge roller 62 may be rotated in a predetermined rotational direction in accordance with the rotation of the conveying roller 60 in the forward direction. The discharge roller 62 may also be rotated in a direction opposite to the predetermined rotational direction in accordance with the rotation of the conveying roller 60 in the backward direction.

According to the illustrative embodiment, the first transmission unit 74 and the second transmission unit 85 include pulleys and belts. Therefore, this configuration may readily implement a configuration for transmitting a driving force of the conveying roller 60 to the discharge roller 62 and further transmitting a driving force of the discharge roller 62 to the reverse roller 45.

According to the illustrative embodiment, each of the pulleys 78 and 79 includes protrusions. The protrusions of the pulley 78 and the protrusions of the pulley 79 are contactable with each other. Therefore, this configuration may readily provide play between the pulleys 78 and 79 in the circumferential direction 104.

According to the illustrative embodiment, a relative positional relationship between the pulleys 78 and 79 may be established in accordance with the amount of the gap between the protrusion 194 and one or the other of the protrusions 198 and 199 or the amount of the gap between the protrusion 195 and one or the other of the protrusions 198 and 199.

According to the illustrative embodiment, reverse rotation of the conveying motor 102 may enable to cause the reverse roller 45 to rotate in a direction to convey a sheet 12 in a direction opposite to the first conveying direction 16A. In other words, the configuration according to the illustrative embodiment may enable conveyance of a sheet 12 in a direction opposite to the first conveying direction 16A, which is impossible if a one-way clutch is equipped on the discharge roller 62 and the reverse roller 45. The sheet 12 conveyed in the direction opposite to the first conveying direction 16A by the reverse roller 45 is guided to the second conveying path 66 by the path switching member 41. Therefore, the recording unit 24 may record an image on a second side of the sheet 12 that has an image recorded on the first side before the sheet 12 passes the second conveying path 66.

According to the illustrative embodiment, the controller 130 executes image recording including the steps of FIG. 12. Therefore, while backward conveyance of a first sheet 12 which is to be conveyed by the discharge roller 62 is prevented or reduced, an accurate skew correction of a subsequent sheet 12 may be implemented by abutting the subsequent sheet 12 against the conveying roller 60 rotating in the backward direction.

[Variations]

In the illustrative embodiment, the printer unit 11 has a function of recording an image on each side of a sheet 12. Nevertheless, in other embodiments, for example, the printer unit 11 may be configured to record an image on only one side of a sheet 12.

Figure 13:
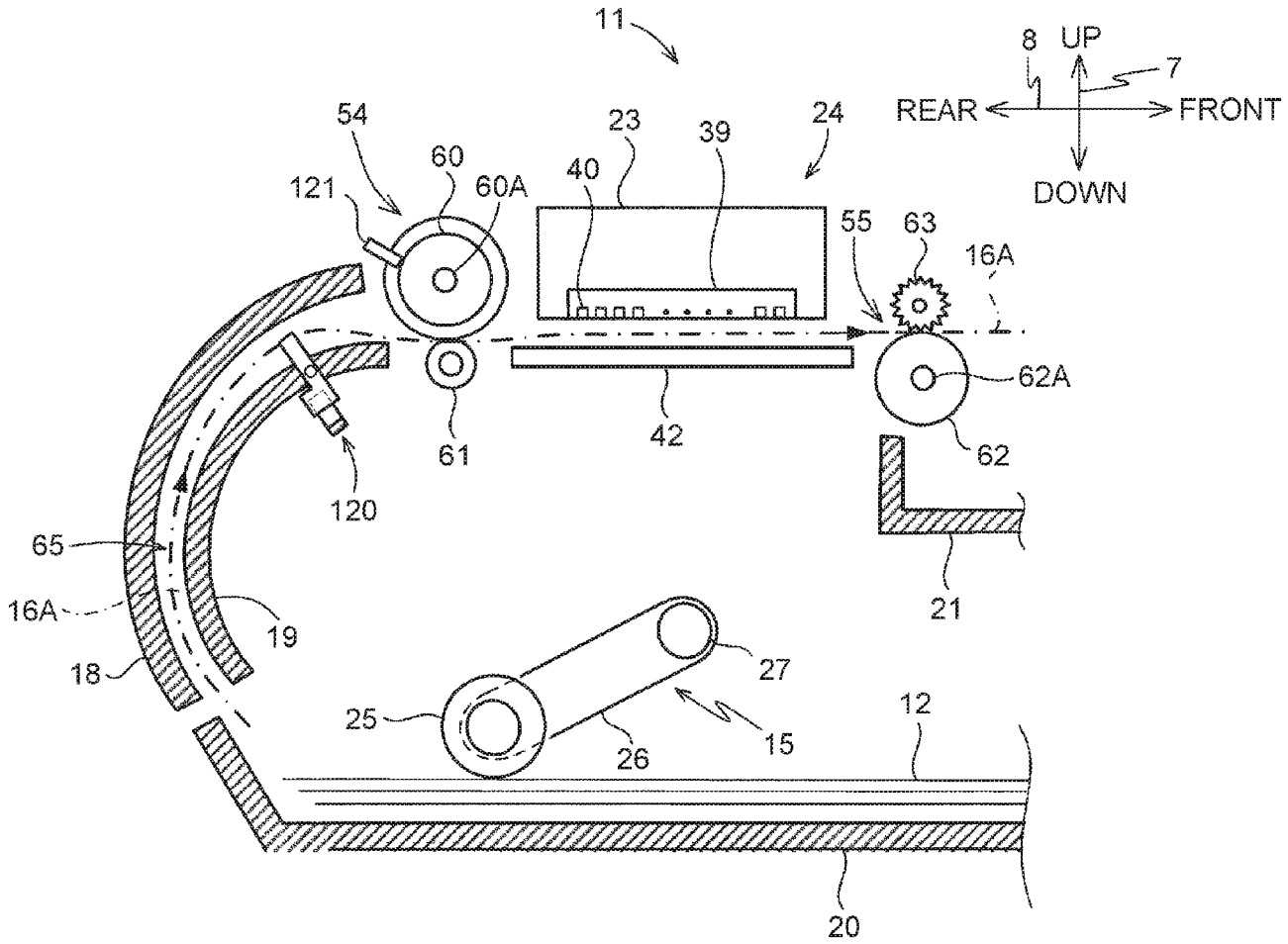
FIG. 13 is a schematic vertical sectional view depicting an internal structure of a printer unit in a variation of the illustrative embodiment according to one or more aspects of the disclosure.

In this case, as depicted in FIG. 13, a printer unit 11 might not include components necessary for recording an image on each side of a sheet 12. For example, the printer unit 11 might not include the reverse roller unit 56, the return roller unit 57, the path switching member 41, the guide members 29 and 30, and the second transmission unit 85. The first transmission unit 74 might not include the pulley 79 either.

In the illustrative embodiment, the pulley 79 includes the protrusions 198 and 199. Nevertheless, in the variation of FIG. 13, for example, the protrusions 198 and 199 may be disposed on a rotary member (as an example of a second rotary member) connected to the discharge roller 62 instead of the pulley 79. For example, the rotary member connected to the discharge roller 62 may include the protrusions 198 and 199 at its surface facing the pulley 78. The protrusions 198 and 199 may protrude from the surface toward the pulley 78. Similar to the illustrative embodiment, the protrusion 198 may be located between the side surface 194A of the protrusion 194 and the side surface 195A of the protrusion 195 in the circumferential direction 104. The protrusion 199 may be located between the side surface 194B of the protrusion 194 and the side surface 195B of the protrusion 195 in the circumferential direction 104. With this configuration, the pulley 78 may have play of a predetermined amount relative to the rotary member connected to the discharge roller 62 in the circumferential direction 104.

What is claimed is:

1. An image recording apparatus comprising:

a conveying motor configured to rotate in a normal direction and in a reverse direction;

a first roller configured to be driven, by the conveying motor rotating in the normal direction and in the reverse direction, to rotate in a forward direction and in a backward direction, respectively, the first roller rotating in the forward direction to convey a sheet in a conveying direction;

a recording unit disposed downstream of the first roller in the conveying direction and configured to record an image on the sheet;

a second roller disposed downstream of the recording unit in the conveying direction and configured to convey the sheet in the conveying direction by rotating in the forward direction; and a first transmission unit configured to transmit a driving force of the conveying motor to the second roller and including a first rotary member, the first rotary member including a plurality of teeth formed on a circumference thereof, wherein the first transmission unit has such play that when the conveying motor is switched from rotation in the normal direction to rotation in the reverse direction, rotation of the second roller in the backward direction is delayed by a predetermined time period from rotation of the first roller in the backward direction, the predetermined time period being greater than a time period corresponding to one tooth of the first rotary member, wherein the first transmission unit further includes a second rotary member configured to transmit to the second roller the driving force of the conveying motor transmitted to the first rotary member, wherein the play of the first transmission unit includes play which is provided between the first rotary member and the second rotary member and is greater than the one tooth of the first rotary member, wherein the first rotary member includes a first end portion and a second end portion which are spaced from each other in a circumferential direction, and the second rotary member includes a third end portion and a fourth end portion which are spaced from each other in the circumferential direction, and wherein the second roller is configured to rotate in the forward direction when the first end portion of the first rotary member presses the third end portion of the second rotary member, and the second roller is configured to rotate in the backward direction when the second end portion of the first rotary member presses the fourth end portion of the second rotary member.

2. The image recording apparatus according to claim 1, wherein the first rotary member is rotatable coaxially with the second roller.

3. The image recording apparatus according to claim 1, wherein the first transmission unit is configured to transmit to the second roller the driving force of the conveying motor transmitted to the first roller.

4. The image recording apparatus according to claim 1, wherein the first transmission unit includes:

a first pulley configured to rotate integrally with the first roller;

a second pulley serving as the first rotary member; and a first belt wound around the first pulley and the second pulley.

5. An image recording apparatus, comprising:

a conveying motor configured to rotate in a normal direction and in a reverse direction;

a first roller configured to be driven, by the conveying motor rotating in the normal direction and in the reverse direction, to rotate in a forward direction and in a backward direction, respectively, the first roller rotating in the forward direction to convey a sheet in a conveying direction;

a recording unit disposed downstream of the first roller in the conveying direction and configured to record an image on the sheet;

a second roller disposed downstream of the recording unit in the conveying direction and configured to convey the sheet in the conveying direction by rotating in the forward direction;

a first transmission unit configured to transmit a driving force of the conveying motor to the second roller and including a first rotary member, the first rotary member including a plurality of teeth formed on a circumference thereof;

a third roller disposed downstream of the second roller in the conveying direction; and a second transmission unit configured to transmit to the third roller the driving force of the conveying motor transmitted to the second roller, wherein the first transmission unit has such play that when the conveying motor is switched from rotation in the normal direction to rotation in the reverse direction, rotation of the second roller in the backward direction is delayed by a predetermined time period from rotation of the first roller in the backward direction, the predetermined time period being greater than a time period corresponding to one tooth of the first rotary member.

6. The image recording apparatus according to claim 5, wherein the first transmission unit includes:

a first pulley configured to rotate integrally with the first roller;

a second pulley serving as the first rotary member;

a first belt wound around the first pulley and the second pulley; and a third pulley disposed adjacent to the second pulley and coaxially with the second roller and configured to rotate integrally with the second roller, and wherein the second transmission unit includes:

a fourth pulley disposed coaxially with the third pulley and configured to rotate integrally with the third roller; and a second belt wound around the third pulley and the fourth pulley.

7. The image recording apparatus according to claim 6, wherein the second pulley includes a first end portion and a second end portion which are spaced from each other in a circumferential direction, and the third pulley includes a third end portion and a fourth end portion which are spaced from each other in the circumferential direction, and wherein the second roller is configured to rotate in the forward direction when the first end portion of the second pulley presses the third end portion of the third pulley, and the second roller is configured to rotate in the backward direction when the second end portion of the second pulley presses the fourth end portion of the third pulley.

8. The image recording apparatus according to claim 5, further comprising a guide member disposed at a first position between the second roller and the third roller in the conveying direction and configured to direct the sheet, which is conveyed in a direction opposite to the conveying direction, from the first position toward a second position upstream of the recording unit in the conveying direction.

9. An image recording apparatus comprising:

a conveying motor configured to rotate in a normal direction and in a reverse direction;

a first roller configured to be driven, by the conveying motor rotating in the normal direction and in the reverse direction, to rotate in a forward direction and in a backward direction, respectively, the first roller rotating in the forward direction to convey a sheet in a conveying direction;

a recording unit disposed downstream of the first roller in the conveying direction and configured to record an image on the sheet;

a second roller disposed downstream of the recording unit in the conveying direction and configured to convey the sheet in the conveying direction by rotating in the forward direction;

a first transmission unit configured to transmit a driving force of the conveying motor to the second roller and including a first rotary member, the first rotary member including a plurality of teeth formed on a circumference thereof;

a tray configured to support sheets;

a feed roller configured to feed sheets from the tray to the first roller which has a contact portion where a sheet fed from the tray contacts the first roller;

a feed motor configured to drive the feed roller;

a sensor disposed upstream of the first roller in the conveying direction and configured to sense a sheet fed by the feed roller; and a controller configured to control the feed motor, the conveying motor, and the recording unit, wherein the first transmission unit has such play that when the conveying motor is switched from rotation in the normal direction to rotation in the reverse direction, rotation of the second roller in the backward direction is delayed by a predetermined time period from rotation of the first roller in the backward direction, the predetermined time period being greater than a time period corresponding to one tooth of the first rotary member, and wherein the controller is configured to:

execute first feeding by rotating the feed motor to cause the feed roller to feed a first sheet from the tray to the first roller;

execute image recording on the first sheet by controlling the recording unit while rotating the conveying motor in the normal direction to cause the first roller to convey the first sheet from the first roller in the conveying direction;

while a trailing edge of the first sheet having an image recorded thereon is positioned between the first roller and the second roller in the conveying direction, execute second feeding by rotating the feed motor to cause the feed roller to feed a subsequent sheet from the tray to the first roller; and when, during the second feeding, a distance between a leading edge of the subsequent sheet and the contact portion of the first roller becomes a first distance which is less than a distance corresponding to the play of the first transmission unit, rotate the conveying motor in the reverse direction to cause the first rotary member to rotate in the backward direction by a predetermined amount which is greater than an amount corresponding to the first distance and less than an amount corresponding to the play.

10. The image recording apparatus according to claim 9, wherein the first transmission unit further includes a second rotary member configured to transmit to the second roller the driving force of the conveying motor transmitted to the first rotary member, and wherein the play of the first transmission unit includes play which is provided between the first rotary member and the second rotary member and is greater than the one tooth of the first rotary member.

11. The image recording apparatus according to claim 9, wherein the first rotary member is rotatable coaxially with the second roller.

12. The image recording apparatus according to claim 9, wherein the first transmission unit is configured to transmit to the second roller the driving force of the conveying motor transmitted to the first roller.

13. The image recording apparatus according to claim 9, wherein the first transmission unit includes:

a first pulley configured to rotate integrally with the first roller;

a second pulley serving as the first rotary member; and a first belt wound around the first pulley and the second pulley.

14. An image recording apparatus comprising:

a conveying motor configured to rotate in a normal direction and in a reverse direction;

a first roller configured to be driven, by the conveying motor rotating in the normal direction and in the reverse direction, to rotate in a forward direction and in a backward direction, respectively, the first roller rotating in the forward direction opposite to the backward direction to convey a sheet in a conveying direction;

a recording unit disposed downstream of the first roller in the conveying direction and configured to record an image on the sheet;

a second roller disposed downstream of the recording unit in the conveying direction and configured to convey the sheet in the conveying direction by rotating in the forward direction;

a transmission unit configured to transmit a driving force of the conveying motor to the second roller and including a first rotary member;

a tray configured to support sheets;

a feed roller configured to feed sheets from the tray to the first roller which has a contact portion where a sheet fed from the tray contacts the first roller;

a feed motor configured to drive the feed roller;

a sensor disposed upstream of the first roller in the conveying direction and configured to sense a sheet fed by the feed roller; and a controller configured to control the feed motor, the conveying motor, and the recording unit, wherein the transmission unit has such play that when the conveying motor changes rotation direction from the normal direction to the reverse direction, rotation of the second roller in the backward direction is delayed by a predetermined time period from rotation of the first roller in the backward direction, the predetermined time period being greater than a time period required for the sheet to be conveyed by 2 mm in the conveying direction when the conveying motor rotates in the normal direction, and wherein the controller is configured to:

execute first feeding by rotating the feed motor to cause the feed roller to feed a first sheet from the tray to the first roller;

execute image recording on the first sheet by controlling the recording unit while rotating the conveying motor in the normal direction to cause the first roller to convey the first sheet from the first roller in the conveying direction;

while a trailing edge of the first sheet having an image recorded thereon is positioned between the first roller and the second roller in the conveying direction, execute second feeding by rotating the feed motor to cause the feed roller to feed a subsequent sheet from the tray to the first roller; and when, during the second feeding, a distance between a leading edge of the subsequent sheet and the contact portion of the first roller becomes a first distance which is less than a distance corresponding to the play of the transmission unit, rotate the conveying motor in the reverse direction to cause the first rotary member to rotate in the backward direction by a predetermined amount which is greater than an amount corresponding to the first distance and less than an amount corresponding to the play.

15. The image recording apparatus according to claim 14, wherein the first rotary member includes a plurality of teeth formed on a circumference thereof, and the predetermined time period is greater than a time period corresponding to one tooth of the first rotary member.

16. The image recording apparatus according to claim 15, wherein the transmission unit further includes a second rotary member configured to transmit to the second roller the driving force of the conveying motor transmitted to the first rotary member, wherein the play of the transmission unit includes play provided between the first rotary member and the second rotary member.

17. The image recording apparatus according to claim 14, wherein the first rotary member is rotatable coaxially with the second roller.

18. The image recording apparatus according to claim 14, wherein the transmission unit is configured to transmit to the second roller the driving force of the conveying motor transmitted to the first roller.

* * * * *